US010035638B1

(12) United States Patent
LeRoy

(10) Patent No.: US 10,035,638 B1
(45) Date of Patent: Jul. 31, 2018

(54) RETENTION PACKAGE WITH ARTICLE-LOADING APERTURE AND METHOD OF MAKING AND USING THE SAME

(71) Applicant: ADE, Inc., Chicago, IL (US)

(72) Inventor: Matthew D. LeRoy, Bourbonnais, IL (US)

(73) Assignee: ADE, INC., Chicago, IL (US)

( * ) Notice: Subject to any disclaimer, the term of this patent is extended or adjusted under 35 U.S.C. 154(b) by 918 days.

(21) Appl. No.: 14/310,154

(22) Filed: Jun. 20, 2014

Related U.S. Application Data

(60) Provisional application No. 61/864,982, filed on Aug. 12, 2013, provisional application No. 61/915,105, filed on Dec. 12, 2013.

(51) Int. Cl.
*B65D 1/24* (2006.01)
*B65D 3/00* (2006.01)
*B65D 81/133* (2006.01)

(52) U.S. Cl.
CPC ..... *B65D 81/133* (2013.01)

(58) Field of Classification Search
CPC ..... B65D 25/54; B65D 25/005; B65D 71/08; B65D 81/07; B65D 1/22; B65D 1/225; B65D 1/24; B65D 25/02; B65D 25/10
USPC ..... 206/461, 466, 484, 486, 562, 583, 594; 220/4.28, 495.05, 528, 62, 62.1, 676; 229/117.3, 117.31
See application file for complete search history.

(56) References Cited

U.S. PATENT DOCUMENTS

| | | | |
|---|---|---|---|
| 1,933,516 | A | 10/1933 | Rosen |
| 2,553,418 | A | 5/1951 | Loth |
| 2,697,546 | A | 12/1954 | Bergstein |
| 2,837,208 | A | 6/1958 | Lingenfelter |
| 3,089,590 | A | 5/1963 | Mell |
| 3,554,368 | A | 1/1971 | Nagel |
| 3,905,474 | A | 9/1975 | Haibara |
| 4,285,432 | A | 8/1981 | de Villers et al. |
| 4,307,804 | A | 12/1981 | Benham |
| 4,606,460 | A | 8/1986 | Luray |
| 4,852,743 | A | 8/1989 | Ridgeway |
| 5,056,665 | A | 10/1991 | Boecker et al. |
| 5,071,009 | A | 12/1991 | Ridgeway |
| 5,115,618 | A | 5/1992 | Janhonen |
| 5,183,159 | A | 2/1993 | Hojnacki et al. |
| 5,226,542 | A | 7/1993 | Boecker et al. |
| 5,287,968 | A | 2/1994 | Ridgeway |

(Continued)

FOREIGN PATENT DOCUMENTS

| | | | |
|---|---|---|---|
| DE | 1465150 | U | 5/1939 |
| DE | 3340155 | A1 | 4/1984 |

(Continued)

*Primary Examiner* — Anthony Stashick
*Assistant Examiner* — Kaushikkumar Desai
(74) *Attorney, Agent, or Firm* — Cook Alex Ltd.

(57) ABSTRACT

Packaging structures that are adapted for insertion into an outer container and containers including packaging structures are disclosed. The packaging structures include a support frame including at least a platform panel having first and second opposed faces, the support frame further including an article-loading aperture. A flexible sheet overlies at least a portion of the first face of the platform panel and the article-loading aperture. An article-receiving area between the flexible sheet and the platform panel is accessible to an article only by loading through the article-loading aperture.

11 Claims, 29 Drawing Sheets

(56) References Cited

U.S. PATENT DOCUMENTS

| | | | |
|---|---|---|---|
| 5,323,896 | A | 6/1994 | Jones |
| 5,388,701 | A | 2/1995 | Ridgeway |
| 5,676,245 | A | 10/1997 | Jones |
| 5,678,695 | A | 10/1997 | Ridgeway et al. |
| 5,694,744 | A | 12/1997 | Jones |
| 5,803,261 | A | 9/1998 | Nowakowski et al. |
| 5,893,462 | A | 4/1999 | Ridgeway |
| 5,967,327 | A | 10/1999 | Jones |
| RE36,412 | E | 11/1999 | Jones |
| 5,975,307 | A | 11/1999 | Harding et al. |
| 6,010,006 | A | 1/2000 | Ridgeway et al. |
| 6,047,831 | A | 4/2000 | Jones |
| 6,073,761 | A | 6/2000 | Jones |
| 6,148,590 | A | 11/2000 | Ridgeway et al. |
| 6,148,591 | A | 11/2000 | Ridgeway et al. |
| 6,158,589 | A | 12/2000 | Smith et al. |
| 6,289,655 | B1 | 9/2001 | Ridgeway et al. |
| 6,302,274 | B1 | 10/2001 | Ridgeway |
| 6,308,828 | B1 | 10/2001 | Jones |
| 6,311,843 | B1 | 11/2001 | Smith et al. |
| 6,311,844 | B1 | 11/2001 | Ridgeway et al. |
| RE37,910 | E | 11/2002 | Nowakowski |
| 6,675,973 | B1 | 1/2004 | McDonald et al. |
| 6,899,229 | B2 | 5/2005 | Dennison |
| 6,913,147 | B2 | 7/2005 | Mueller et al. |
| 6,920,981 | B2 | 7/2005 | Lofgren et al. |
| 6,923,324 | B2 | 8/2005 | Kanai |
| 7,082,274 | B2 | 7/2006 | Saitoh et al. |
| 7,086,534 | B2 | 8/2006 | Roesel |
| 8,123,039 | B2 | 2/2012 | McDonald et al. |
| 8,177,067 | B2 | 5/2012 | McDonald et al. |
| 8,181,787 | B2 | 5/2012 | Klos |
| 8,235,216 | B2 | 8/2012 | McDonald et al. |
| 2001/0047950 | A1 | 12/2001 | Beneroff et al. |
| 2004/0140243 | A1 | 7/2004 | Roesel |
| 2004/0178113 | A1 | 9/2004 | Lofgren et al. |
| 2011/0240515 | A1 | 10/2011 | Ridgeway |
| 2013/0233752 | A1 | 9/2013 | Hammerschmidt |

FOREIGN PATENT DOCUMENTS

| | | |
|---|---|---|
| GB | 475299 A | 11/1937 |
| GB | 1224493 | 3/1971 |
| JP | 48-143793 | 12/1948 |
| JP | 49-59982 | 5/1974 |
| JP | 49-77087 | 7/1974 |
| JP | 50-88376 | 7/1975 |
| JP | 50-102778 | 8/1975 |
| JP | 50-107583 | 9/1975 |
| JP | 53-135796 | 11/1978 |
| JP | 57-177969 | 11/1982 |
| JP | 3-100158 | 10/1991 |
| SU | 685567 | 9/1979 |
| SU | 827346 | 5/1981 |

RETENTION PACKAGE WITH ARTICLE-LOADING APERTURE AND METHOD OF MAKING AND USING THE SAME

This application claims priority to and the benefit of U.S. Provisional Patent Application No. 61/864,982 filed Aug. 12, 2013 and U.S. Provisional Patent Application No. 61/915,105 filed Dec. 12, 2013, which are hereby incorporated by reference herein.

FIELD OF DISCLOSURE

This disclosure relates generally to packaging, and more particularly to retention packaging structures for supporting and protecting articles from damage during shipping, and to methods of making and using the same. The retention packaging structures are adapted for insertion into an outer container.

BACKGROUND

When shipping an article or product that is sensitive to impact or movement within a container, various packaging structures may be used to avoid damage to the article by providing spacing between walls of a container and the article, and by holding the article in a preselected position within the container. The use of such packaging structures is useful for transporting articles that may or may not necessarily be regarded as being fragile and for which immobilization during shipment is desirable, such as, for example, cell phones, laptop or notebook computers, handheld electrical devices, books, compact discs (CDs), digital video discs (DVDs), and a variety of other articles. These types of articles also may be subjected to damage in shipment, such as scuffing, dulling or the like, which is caused by movement against and within a container. This form of damage may be caused by gross movement of the product and/or impact with the interior wall of the container, or even by movement wherein the product rubs against a support structure within the container.

Some of the prior art packaging structures are constructed as retention packaging configured to retain an article against a substantially rigid panel that is constructed of corrugated fiberboard or other forms of cardboard, or plastic, by using flexible sheet material, which is held in tension. Other forms of such prior art packaging structures are constructed as suspension packaging that is configured to suspend an article between sheets of flexible material that are held in a position spaced from walls of the container. While such packaging structures may be useful, they may be complex, relatively expensive to assemble, and require substantial amounts of flexible sheet material and corrugated fiberboard or cardboard, or the like. Accordingly, there is a continuing need for improved and low cost packaging structures that provide sufficient protection for an article, while providing ease of use and reduced cost.

SUMMARY

The scope of the present disclosure is defined solely by the appended claims, and nothing in this summary is intended to limit the claims. Moreover, there are several aspects of the present subject matter that may be embodied separately or together in various packages or packaging structures. These aspects may be employed alone or in combination with other aspects of the subject matter described herein and the description of these aspects together is not intended to preclude use of these aspects separately or the claiming of such aspects separately or in different combinations, as set forth in the claims appended hereto.

The present disclosure addresses one or more disadvantages of the prior art and provides efficient packaging arrangements that are capable of holding articles against a rigid or flexible platform panel and spaced from walls of a container. Indeed, the devices provide efficiencies with respect to ease of manufacturing, material use, cost, weight, bulk and in some examples, the lack of use of separate fasteners, while still providing numerous highly advantageous configurations to meet the needs associated with ease of use and shipment of particular articles. It will be appreciated that "side", "end", "top" and "bottom" may be used herein for purposes of reference or identification only and are not intended to suggest any particular location, dimensional quality or orientation, or to necessarily suggest any association with any particular direction.

It further will be appreciated that the disclosure provides several examples having a support frame that includes a platform panel and at least one article-loading aperture or opening through which an article or object may be loaded into an article-receiving area wherein it is positioned between an overlying flexible sheet and the platform panel. To enhance flexibility and ease of loading of an article, the support frame also may include at least one opening and/or a weakened zone, which may be formed in the platform panel and over which the article will pass when being inserted or loaded through the article-loading aperture to be positioned in the article-receiving area between the flexible sheet and the platform panel. The at least one opening and/or weakened zone may be formed in many ways, which may range from one or more relatively narrow slits or apertures, as well as other broader openings of various shapes and sizes. In addition, ease of completing the loading of an article or object into a container may be enhanced still further by having the support frame preloaded into the container and having the at least one article-loading aperture in the support frame aligned with an aperture in a wall of the container or by having the at least one article-loading aperture be integrally formed as a part of the container.

In one aspect, a packaging structure is provided that is adapted for insertion into an outer container. The packaging structure includes a support frame having at least a platform panel having first and second opposed faces. The support frame also includes at least one article-loading aperture and at least a first pair of opposed side panels pivotally connected to first opposed sides of the platform panel. A flexible sheet overlies at least a portion of the first face of the platform panel and extends over and beyond the at least one article-loading aperture in the support frame. The flexible sheet also overlies at least a portion of one of the at least first pair of opposed side panels and is connected thereto with the connection of the flexible sheet to the platform panel defining a substantially continuous zone of connection to form an article-receiving area between the flexible sheet and the first face of the platform panel. The article-receiving area is circumscribed by the substantially continuous zone of connection and is accessible to an article only by loading through the article-loading aperture, and the flexible sheet overlying the platform panel is tensioned when at least one side panel is pivoted away from the first face of the platform panel. Preferably, the zone connection is continuous and the flexible sheet has all its edge portions connected to the support frame, such that there is no unsecured or free edge portion, e.g., which would allow for insertion of an article between the flexible sheet and the first face of the platform panel.

In accordance with another aspect, a method of making a packaging structure adapted for insertion into an outer container is provided. The method includes the steps of providing a support frame having at least a platform panel having first and second opposed faces and at least one article-loading aperture, and at least a first pair of opposed side panels pivotally connected to first opposed sides of the platform panel, providing a flexible sheet overlying at least a portion of the first face of the platform panel and extending over and beyond the at least article-loading aperture in the support frame, and connecting the flexible sheet to the at least one of the first pair of opposed side panels and to the support frame along a substantially continuous zone of connection that forms an article-receiving area between the flexible sheet and the first face of the platform panel, which article-receiving area is circumscribed by the substantially continuous zone of connection and is accessible to an article only by loading through the article-loading aperture.

In a further aspect, a packaging structure is provided that includes a container having side walls that define a cavity when pivoted to a closed position, a support frame having at least a platform panel having first and second opposed faces, the support frame having at least one article-loading aperture therein, and at least a first pair of opposed side panels pivotally connected to first opposed sides of the platform panel. A flexible sheet overlies at least a portion of the first face of the platform panel and extends over and beyond the at least one article-loading aperture in the support frame, the flexible sheet also overlying at least a portion of one of the at least first pair of opposed side panels and being connected thereto with the connection of the flexible sheet to the support frame defining a substantially continuous zone of connection to form an article-receiving area between the flexible sheet and the first face of the platform panel, which article-receiving area is circumscribed by the substantially continuous zone of connection and is accessible to an article only by loading through the article-loading aperture, wherein the flexible sheet overlying the platform panel is tensioned when at least one of the side panels is pivoted away from the first face of the platform panel, and wherein the support frame is positioned within the cavity defined by the side walls of the container.

In another aspect, a container having a packaging structure is provided that includes a container having side walls that define a cavity when pivoted to a closed position, a support frame connected to at least one of the side walls of the container and having at least a platform panel having first and second opposed faces, the support frame having at least one article-loading aperture therein, a flexible sheet overlying at least a portion of the first face of the platform panel and extending over and beyond the at least one article-loading aperture in the support frame, the flexible sheet being connected to the support frame wherein an article-receiving area is formed between the flexible sheet and the first face of the platform panel, wherein when pivoted into a container configuration the article-receiving area is accessible to loading of an article only by loading through the article-loading aperture, and wherein the support frame is positioned within the cavity defined by the side walls of the container.

In yet another aspect, an integral packaging structure is provided includes a support frame, a base panel pivotally connected to the support frame and a lid panel pivotally connected to the support frame, each of the support frame, base panel and lid panel having first and second opposed faces, respectively. The support frame including a platform panel having first and second opposed faces. A flexible sheet overlies at least a portion of the first face of the support frame and at least a portion of the platform panel and extends over and beyond an article loading aperture in the support frame, the flexible sheet being connected to the support frame along a substantially continuous zone of connection to form an article receiving area between the flexible sheet and the first face of the platform panel. The support frame is pivotable relative to the base panel to a pivoted position with the first face of the platform panel in generally face-to-face relation with the first face of the base panel. The lid panel is pivotable relative to the base panel to a pivoted position in which the first face of the lid panel is in generally face-to-face relation with the second face of the platform panel in the pivoted condition, thereby positioning the platform panel between the base pane and lid panel and covering the article loading aperture in the support frame, and one or more of the panels includes side panels or walls configured to retain the support platform, base panel and lid panel in the pivoted positions The novel and nonobvious structures and methods of making and using retention packages disclosed herein allow for unique packaging solutions and present various configurations to provide desired features for end users. The retention packages may be quickly, conveniently and efficiently manufactured, with the support frames and flexible sheets.

BRIEF DESCRIPTION OF THE DRAWINGS

In describing the preferred embodiments, reference is made to the accompanying drawing figures wherein like parts have like reference numerals, and wherein.

Figure 1:
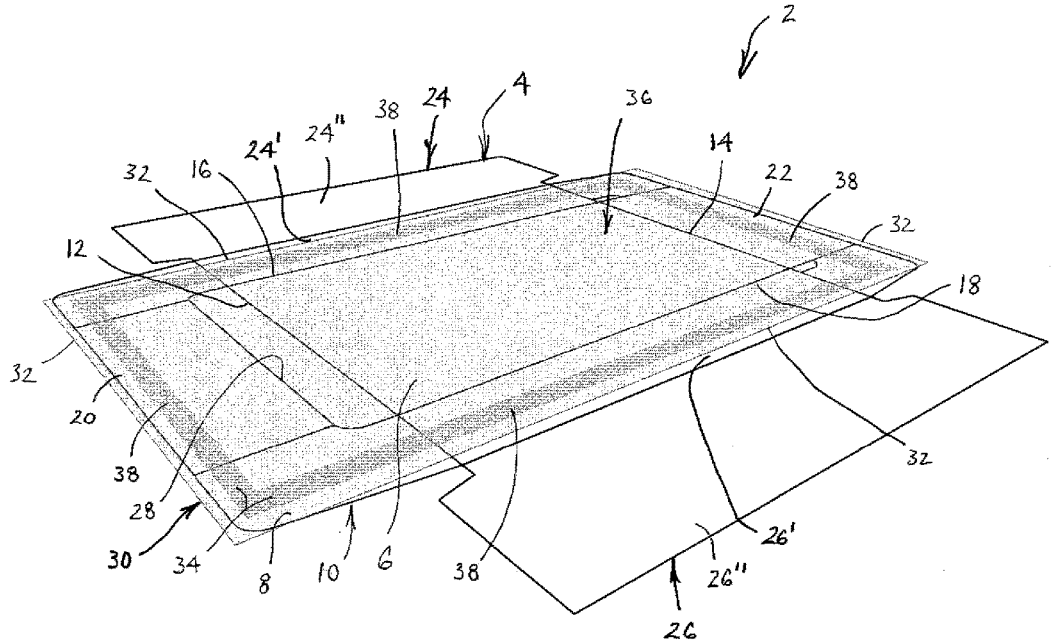
FIG. 1 is an upper perspective view of a first packaging structure adapted for insertion into an outer container and illustrating a support frame shown in a planar orientation and including a platform panel having opposed first and second faces, with at least a first pair of opposed side panels pivotally connected to first opposed sides of the platform panel and at least a second pair of opposed side panels pivotally connected to second opposed sides of the platform panel, and the support frame also having an article-receiving aperture, and a flexible sheet overlies the first face of the platform panel and the article-receiving aperture.

It should be understood that the drawings are not to scale. While some details of retention packages and other plan and section views of the particular components have not been included, such details are considered to be within the comprehension of those of skill in the art in light of the present disclosure. It also should be understood that the present invention is not limited to the examples illustrated.

DESCRIPTION OF ILLUSTRATED EMBODIMENTS

Although the following discloses examples of retention packages, persons of ordinary skill in the art will appreciate that the teachings of this disclosure are in no way limited to the specific examples shown. On the contrary, it is contemplated that the teachings of this disclosure may be implemented in alternative configurations, with alternative materials and in alternative environments.

In general, the example retention packages and methods of making and using the same described herein facilitate convenient, cost effective and protective devices. FIGS. 1-8 show at least two advantageous examples of such retention packages.

Turning to FIGS. 1-6, a first example packaging structure is illustrated generally at 2 and includes a support frame 4. The support frame 4 includes a platform panel 6 having first and second opposed faces 8, 10, first opposed sides 12, 14 and second opposed sides 16, 18. A first pair of opposed side panels 20, 22 are pivotally connected to the platform panel 6 at the first opposed sides 12, 14, while a second pair of opposed side panels 24, 26 are pivotally connected to the platform panel 6 at the second opposed sides 16, 18, with the pivotal connections being along fold lines or other lines of weakness. Fold lines or lines of weakness in a support frame may be formed in many ways, such as, for example, by compressing a localized area, perforating or otherwise partially cutting through a portion of the support frame, or connecting two separate portions together, such as by use of tape, adhesive or other suitable structures. Indeed, the support frame 4 may be constructed of any suitable relatively rigid material, and may incorporate multiple materials for particular purposes, but preferably is constructed of corrugated fiberboard or other cardboard because of its light weight and ready ability to be recycled.

The platform panel 6 of this example provides an essentially continuous first face, but alternatively could include one or more openings or zones of weakness. The illustrated example platform panel 6 generally is rectangular in shape, but the actual shape used for the platform panel may be varied as the particular packaging requirements demand, and one or more openings may be employed. The support frame 4 has an overall length in a first direction that includes the platform panel 6 and the first pair of opposed side panels 20, 22 when the platform panel 6 and the first pair of opposed side panels 20, 22 are disposed in a planar orientation, such as is shown in FIG. 1. The support frame 4 has an overall length in a second direction that includes the platform panel 6 and the second pair of opposed side panels 24, 26 when the platform panel 6 and the second pair of opposed side panels 24, 26 also are disposed in a planar orientation.

The support frame 4 also includes at least one article-loading aperture 28. In this example, the article-loading aperture 28 is located in one of the first opposed side panels 20, along the first opposed side 12 of the platform panel 6. As illustrated, one edge of the aperture lies along the fold line between the side panel 20 and the platform panel 6. It will be appreciated that the article-loading aperture is intended to permit loading of an article from opposite the first face 8 of the support frame 4, and with a support frame of this general construction, one or more article-loading apertures could be located elsewhere in the support frame 4, such as in any of the respective first or second opposed side panels 20, 22, 24, 26, in the platform panel 6, and/or spanning from an opposed side panel 20, 22, 24, 26 into the platform panel 6.

A flexible sheet 30 is connected to the support frame 4. The flexible sheet 30 overlies at least a portion of the first face 8 of the platform panel 6 and extends over and beyond the at least one article-loading aperture 28 in the support frame 4. The flexible sheet 30 also overlies at least a portion of one of the at least one first pair of opposed side panels 20, 22 and is connected thereto with the connection of the flexible sheet 30 to the support frame 4 defining a substantially continuous zone of connection 34 to form an article-receiving area 36 between the flexible sheet 30 and the first face 8 of the platform panel 6. The article-receiving area 36 is circumscribed by the substantially continuous zone of connection 34 and is accessible to an article only by loading through the article-loading aperture 28. The flexible sheet 30 overlying the platform panel 6 also is tensioned when at least one of the at least first pair of opposed side panels 20, 22 is pivoted away from the first face 8 of the platform panel 6.

The flexible sheet 30 may be constructed of any suitable flexible material, such as a polymeric or plastic film, including but not limited to materials such as polyethylene, polyurethane, polyvinyl chloride or any other suitable materials, or fabric, mesh or other suitable materials, any of which preferably is resilient, stretchable and non-abrasive. In this example, the flexible sheet 30 has outer edges 32 and is of a size generally to overlie at least a portion of the first face 8 of the platform panel 6, to extend over and beyond the at least one article-loading aperture 28 in the support frame 4, and to overlie at least a portion of one of the at least first pair of opposed side panels 20. The connection of the flexible sheet 30 to the support frame 4 defines the substantially continuous zone of connection 34, whether the connection is to the first face 8 of the platform panel 6 and/or to the first and/or second opposed side panels 20, 22, 24, 26, and forms an article-receiving area 36 between the flexible sheet 30 and the first face 8 of the platform panel 6. Thus, the article-receiving area 36 is at least circumscribed by the substantially continuous zone of connection 34 of the flexible sheet 30 to the support frame 4. As such, the article-receiving area 36 is accessible to an article only by loading through the article-receiving aperture 28.

The connection of the flexible sheet 30 effectively may be made to a single face of the support frame 4 in a very efficient and cost effective manner, such as by use of adhesive, in the form of glue lines 38, glue strips, mechanical fasteners or other suitable means of connection, which may be in a strictly continuous or intermittent in pattern, but which will establish the substantially continuous zone of connection 34. Thus, none of the edges 32 of the flexible sheet 30 is not connected or is unsecured in a manner or dimension that would permit insertion into the article-receiving area 36 from between an unsecured edge of the flexible sheet 30 and the support frame 4. Accordingly, article loading must be initiated through the article-loading aperture 28 in the support frame 4 and from opposite the face of the support frame 4 to which the flexible sheet 30 is connected.

Thus, in constructing the example packaging structure 2, glue lines 38 may be applied to the support frame 4 in a pattern generally along and parallel to outer edges of the first pair of opposed side panels 20, 22, and along a portion of the second pair of opposed side panels 24, 26. The flexible sheet 30 may be brought into contact with the support frame 4 and attached thereto along the glue lines 38. It will be appreciated that the flexible sheet 30 may be shorter or longer in length than the overall length of the support frame 4 in the first and/or second directions. Also, the platform panel 6 may be of a construction that is substantially rigid or having some flexibility, as will be discussed herein with respect to the second example.

Figure 2:
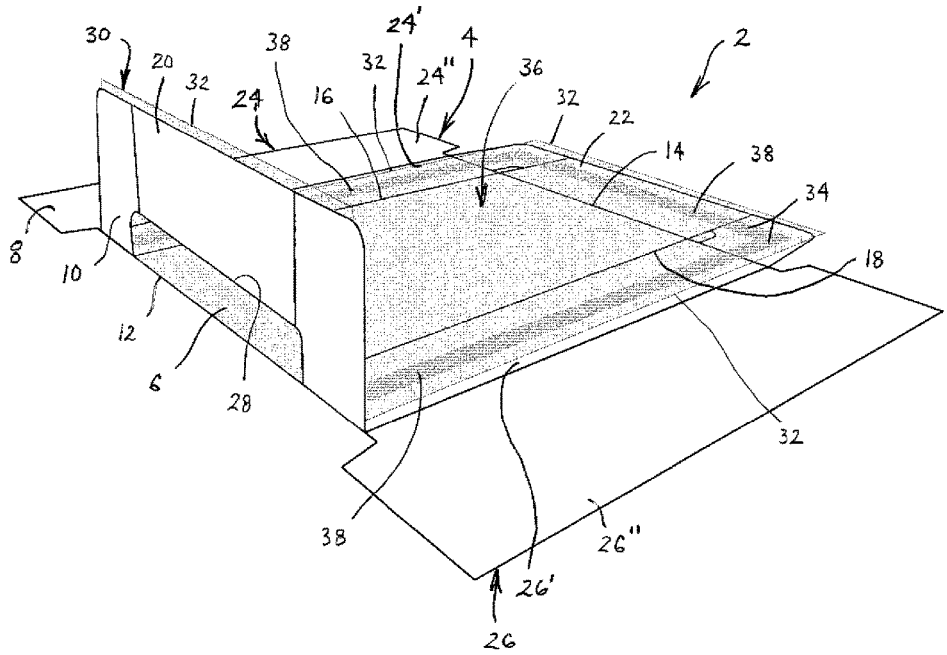
FIG. 2 is a further upper perspective view of the first packaging structure of FIG. 1 shown with the article-loading aperture formed in one of the first opposed side panels that is pivoted to a position perpendicular to the platform panel wherein the article-loading aperture is positioned to permit loading of an article between the flexible sheet and the first face of the platform panel.
Figure 3:
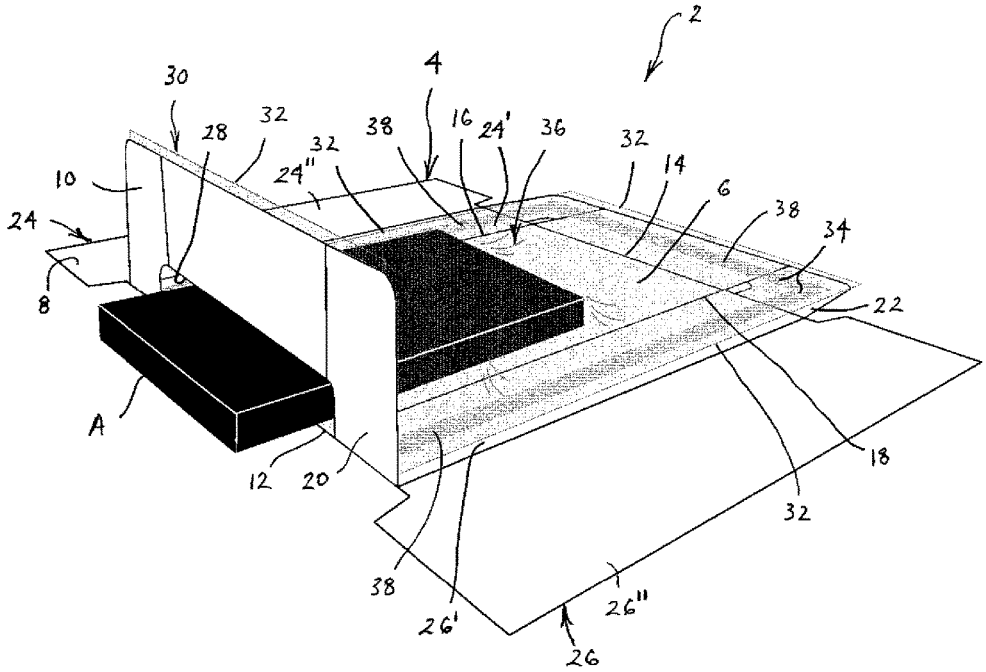
FIG. 3 is an upper perspective view of the packaging structure similar to FIG. 2 but also showing an article being inserted through the article-loading aperture to be positioned in an article-receiving area between the flexible sheet and the first face of the platform panel.

As may be seen in FIGS. 2 and 3, when an article-receiving aperture is formed in one or more of the side panels of the first and/or second opposed side panels, such as the article-loading aperture 28 in the first opposed side panel 20 of the first example, article loading may be facilitated by pivoting the opposed side panel 20 to a position perpendicular to the platform panel 6. This presents to the user a clearly defined aperture for insertion of an article A, while holding the flexible sheet 30 partially away from the first face 8 of the platform panel 6 to try to reduce obstruction and provide for easier insertion. In this example, the article A is depicted generally as a small rectangular block. However, it will be appreciated that the article may be of any shape and size, with appropriate adjustments in the shape and size of packaging structure and the article-loading aperture, the rigidity of the platform panel, the material and tightness of the overlying flexible sheet, and the tension generating configuration relating to the connection of the flexible sheet to one or more pivoting side panels. Accordingly, the article A may be inserted through the article-loading aperture 28 and into the article-receiving area 36 between the flexible sheet 30 and the first face 8 of the platform panel 6.

Figure 4:
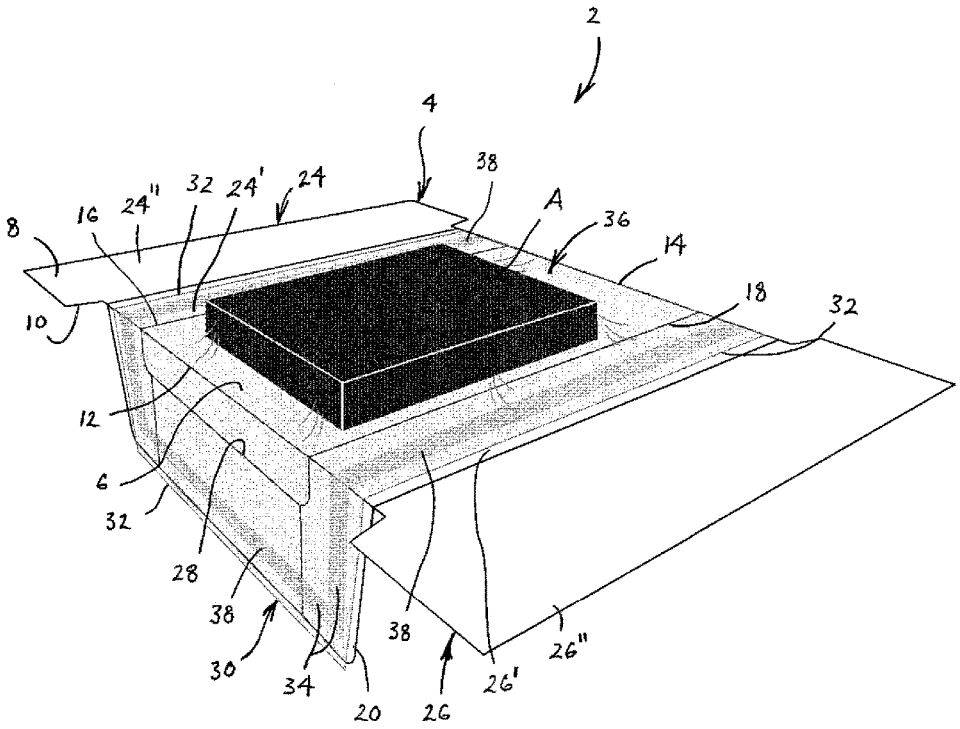
FIG. 4 is an upper perspective view of the packaging structure of FIG. 1 having an article located in the article-receiving area between the flexible sheet and the first face of the platform panel and having the first opposed side panels pivoted away from the first face of the platform panel, resulting in tensioning of the flexible sheet.

The shape and size of the article A may cause the flexible sheet 30 to stretch or any of the other first and second opposed side panels 22, 24, 26 to tend to pivot toward the first face 8 of the platform panel 6 to more readily accommodate the thickness and contours of the article A. As shown in FIG. 4, to hold the article A in place against the platform panel 6, the first pair of opposed side panels 20, 22 are pivoted away from the first face 8 and toward the second face 10 of the platform panel 6 along the first opposed sides 12, 14 of the platform panel 6, at fold lines or other lines of weakness. This increases the tension in the flexible sheet 30 that extends beyond the article-loading aperture 28 and is connected to at least the one first opposed side panel 20, and in this example is connected to the first pair of opposed side panels 20, 22. The tension in the flexible sheet 30 will tend to force the article A to press downward against the first face 8 of the platform panel 6, which will help prevent shifting or movement of the article A when placed within an outer container.

Figure 5:
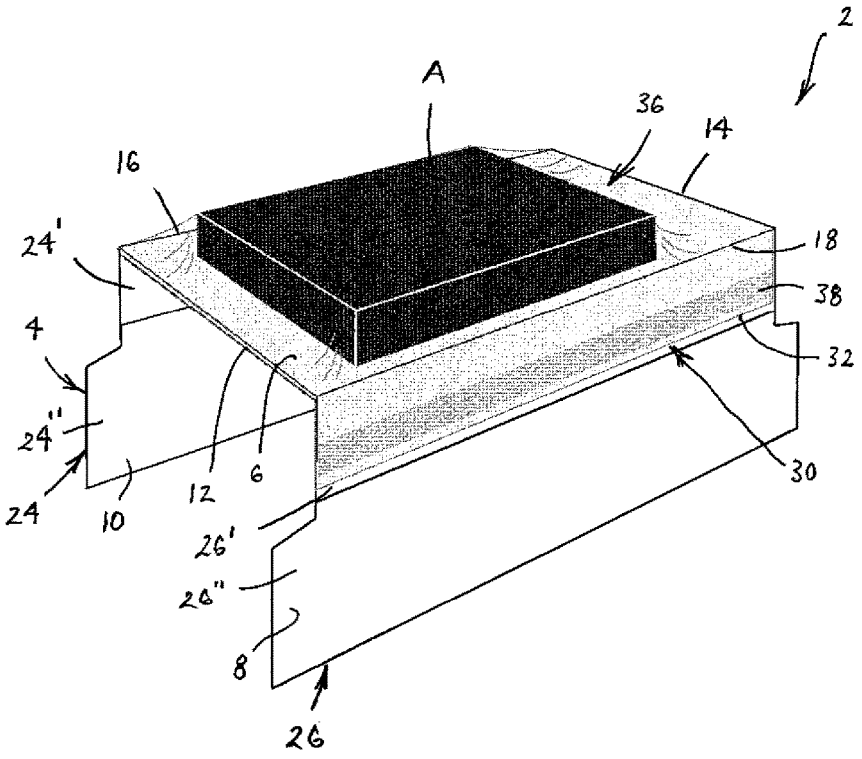
FIG. 5 is an upper perspective view of the packaging structure of FIG. 1 having an article located in the article-receiving area between the flexible sheet and the first face of the platform panel, having the first opposed side panels pivoted toward the second face of the platform panel further than shown in FIG. 4, and having the second opposed side panels pivoted away from the first face of the platform panel to a position perpendicular to the platform panel, resulting further tensioning of the flexible sheet.

As seen in FIG. 5, with the article A located within the article-receiving area 36 and the first pair of opposed side panels 20, 22 pivoted away from the first face 8 and toward the second face 10 of the platform panel 6, and the second pair of opposed side panels 24, 26 may be pivoted away from the first face 8 and toward the second face 10 of the platform panel 6 along the second opposed sides 16, 18 of the platform panel 6, at fold lines or other lines of weakness. This provides further tension in the flexible sheet 30 and tends to force the article A to press downward on the platform panel 6. This also will help hold the article A from shifting laterally and thereby avoiding potential abrasions, scuffing or other damage to the article A, which can otherwise occur when corrugated or non-corrugated fiberboard or cardboard is in contact with a surface and is subjected to extended intermittent motion. Also, drawing down the flexible sheet in all directions helps isolate the article A from shock that is due to impacts to an outer container, and depending on the platform panel, may effectively provide for a sealed environment for the article.

Figure 6:
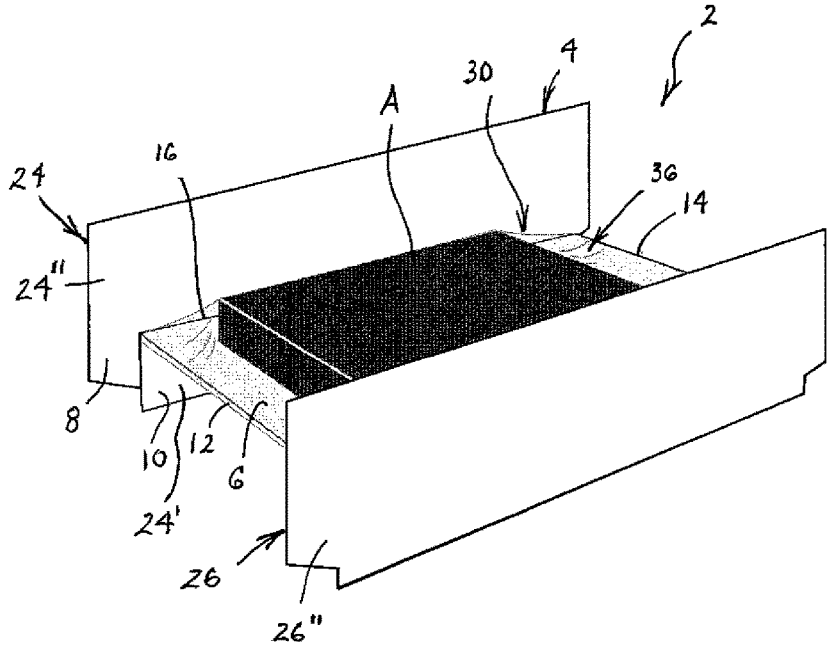
FIG. 6 is an upper perspective view of the packaging structure similar to FIG. 5 but having each of the second opposed side panels pivoted back upon itself, with inner and outer portions of each of the second opposed side panels in a position perpendicular to the platform panel, illustrating a configuration in which the support frame is ready for insertion of the packaging structure into an outer container to support the article on the support frame spaced from the walls of the outer container.
Figure 7:
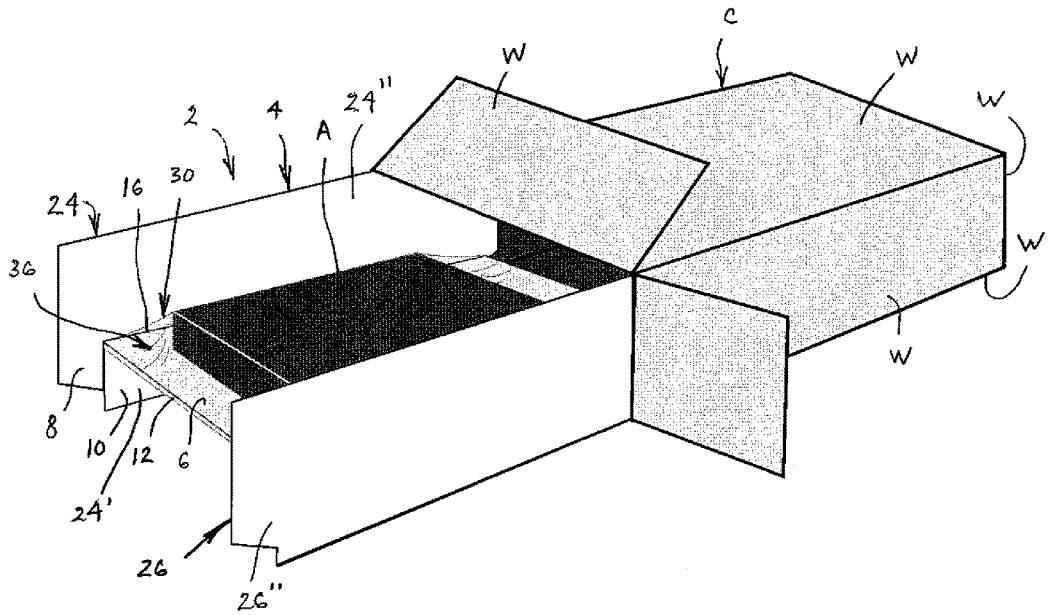
FIG. 7 is an upper perspective view of the packaging structure similar to FIG. 6 but showing the packaging structure being inserted into an outer container to support the article on the support frame spaced from the walls of the outer container.

In this example, each of the second pair of opposed side panels 24, 26 includes a further fold line or line of weakness, defining a respective inner portion 24', 26' and outer portion 24", 26", which permit each of the second opposed side panels 24, 26 to be pivoted back upon itself, resulting in the inner and outer portions of each of the second opposed side panels 24, 26 achieving a position perpendicular to the platform panel 6. This can be appreciated when viewing FIGS. 5 and 6, with FIG. 6 illustrating the packaging structure 2 in a configuration in which the support frame 4 is ready for insertion of the packaging structure 2 into an outer container. The length and width of the inner portions 24', 26' and outer portions 24", 26" will locate the article A and platform panel 6 on which it rests in a position spaced from the walls W of an outer container C, shown in FIG. 7 as a box, but which also may be configured as an envelope or other suitable container for shipping.

A method of making a packaging structure 2 that is adapted for insertion into an outer container, therefore, is provided. The method includes the steps of providing a support frame 4 having at least a platform panel 6 having first and second opposed faces 8, 10 and at least one article-loading aperture 28 therein, with the support frame 4 having at least a first pair of opposed side panels 20, 22 pivotally connected to first opposed sides 12, 14 of the platform panel 6 and at least a second pair of opposed side panels 24, 26 pivotally connected to second opposed sides 16, 18 of the platform panel 6. The method includes providing at least a portion of the first face 8 of the platform panel 6 and extending over and beyond the at least one article-loading aperture 28 in the support frame 4, and connecting the flexible sheet 30 to the at least one of the first pair of opposed side panels and to the support frame 4 along a substantially continuous zone of connection 34 that forms an article-receiving area 36 between the flexible sheet 30 and the first face 8 of the platform panel 6, which article-receiving area 36 is circumscribed by the substantially continuous zone of connection 34 and is accessible to an article A only through the article-loading aperture 28.

It will be appreciated that the packaging structure 2 is used by inserting one or more articles A between the flexible sheet 30 and the platform panel 6. The first pair of opposed side panels 20, 22 then are pivoted away from the first face 8 and toward the second face 10 of the platform panel 6 to tension the flexible sheet 30 and help hold the one or more articles A in position. Then, the second pair of opposed side panels 24, 26 are pivoted away from the first face 8 and toward the second face 10 of the platform panel 6 to further tension the flexible sheet 30 and more securely hold the one or more articles A in position on the platform panel 6. The outer portions 24", 26" of the second pair of opposed side panels 24, 26 then are pivoted back toward the inner portions 24', 26' of such second pair of opposed side panels 24, 26 and toward the first face 8 of the platform panel 6. The packaging structure 2 and the one or more articles A then are ready to be placed in an outer container C for shipment. To provide additional cushioned support for the one or more articles A, the inner portions 24', 26' of the second opposed side panels 24, 26 may be pivoted beyond a vertical orientation before placing the packaging structure 2 in an outer container having an appropriate reduced height, so as to permit the packaging structure 2 to act as a spring suspension.

When an article arrives within a packaging structure 2 of this example, the packaging structure 2 advantageously provides at least three ways in which the article may be removed from the article-receiving area 36. In a first method of article removal, the pivoting of the first and second pairs of opposed side panels 20, 22, 24, 26 may be reversed toward achieving a more planar orientation of the support frame 4, and until an edge of the flexible sheet 30 may be grasped by a user and pulled to separate the flexible sheet 30 from the support frame 4, exposing the article to be grasped by the user. Thus, a corner of the sheet 30 may be of sufficient length to be grasped and pulled to separate the connection between the flexible sheet 30 and the support frame 4. In a second method of article removal, the pivoting of the side panels 22, 24, 26 may be reversed toward achieving a more planar orientation of the support frame 4, while having the other one of the first pair of opposed side panels 20, which includes the article-loading aperture 28, returned to a position perpendicular to the platform panel 6, permitting the article to be forced outward through the article-loading aperture 28. In a third method of article removal, the flexible sheet 30 simply may be cut or torn to access and remove the article.

Figure 8:
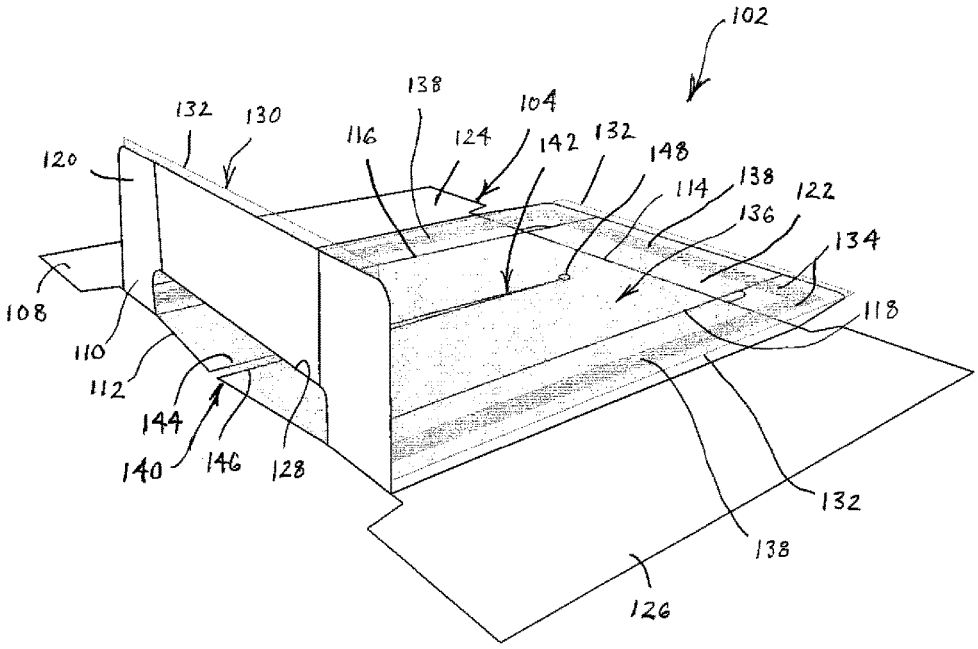
FIG. 8 is an upper perspective view of an alternative example of a packaging structure that is of somewhat similar construction to the packaging structure shown in FIGS. 1-7, in a position similar to that shown in FIG. 2, but including a weakened zone in the platform panel that permits flexing of a portion of the platform panel away from the flexible sheet when an article is being inserted through the article-loading aperture.

FIG. 8 shows a second example packaging structure 102 that is illustrated as being constructed in a manner somewhat similar to the way the first example packaging structure 2 is constructed. Accordingly, the packaging structure 102 includes a support frame 104 having at least a platform panel 106 having first and second opposed faces 108, 110. The support frame 104 includes at least one article-loading aperture 128. At least a first pair of opposed side panels 120, 122 are pivotally connected to first opposed sides 112, 114 of the platform panel 106, such as along fold lines or other lines of weakness, which may be formed in a manner as discussed with respect to the above first example. The support frame 104 also may be constructed of various different materials, as discussed above with respect to the first example packaging structure 102.

The second example packaging structure 102 also may include at least a second pair of opposed side panels 124, 126 which are pivotally connected to second opposed sides 116, 118 of the platform panel 106, similarly along fold lines or other lines of weakness. The second pair of opposed side panels 124, 126 also include inner portions 123', 126' and outer portions 124", 126". As with the prior example, the support frame 104 has an overall length in a first direction that includes the platform panel 106 and the first pair of opposed side panels 120, 122 when the support frame 104 and the first pair of opposed side panels 120, 122 are disposed in a planar orientation, and an overall length in a second direction that includes the platform panel 106 and the second pair of opposed side panels 124, 126 when the support frame 104 and the second pair of opposed side panels 124, 126 are disposed in a planar orientation.

A flexible sheet 130 is provided, as discussed above with respect to the first example in terms of size and various types of material that may be used. The flexible sheet 130 overlies at least a portion of the first face 108 of the platform panel 106 and extends over and beyond the at least one article-loading aperture 128 in the support frame 104. The flexible sheet 130 also overlies at least a portion of one of the at least one first pair of opposed side panels 120, 122 and is connected thereto with the connection of the flexible sheet 130 to the support frame 104 defining a substantially continuous zone of connection 134 to form an article-receiving area 136 between the flexible sheet 130 and the first face 108 of the platform panel 106. The article-receiving area 136 is circumscribed by the substantially continuous zone of connection 134 and is accessible to an article only by loading through the article-loading aperture 128. The flexible sheet 130 overlying the platform panel 106 also is tensioned when the at least one of the at least first pair of opposed side panels 120, 122 is pivoted away from the first face 108 of the platform panel 106.

In both examples, tension is further provided by having both of the first pair of opposed side panels 120, 122 pivoted away from the first face 108 of the platform panel 106. Additional tension is provided by the connection of the flexible sheet 130 to the second pair of opposed side panels 124, 126 and the subsequent pivoting of the second pair of opposed side panels 124, 126 away from the first face 108 of the platform panel 106.

In this second example, the platform panel 106 includes at least one opening and/or weakened zone 140. In this example, the weakened zone 140 in the platform panel 106 is defined by a slit 142 having parallel edges 144, 146. The slit 142 is shown as being connected to the article-loading aperture 128 at one end and flaring into a larger generally circular-shaped opening 148 at the opposed end. Such a flared opening 148 at the end of the slit 142 reduce stress concentration and provides increased resistance to tearing of the platform panel 106. It will be appreciated that the weakened zone may include one or more slits and/or openings, and may be varied as the particular packaging requirements demand, so as to take advantage of some flexibility in the platform panel.

In the second example, the slit 142 and opening 148 of the weakened zone 140 form a flexible platform panel 106 that permits some flexing of the platform panel 106. Such flexing can be particularly advantageous while loading or inserting an article through the article-loading aperture 128 and into the article-receiving area 136 between the flexible sheet 130 and the platform panel 106. By permitting an article to press downward and essentially somewhat through the plane of the platform panel 106, the weakened zone 140 may relieve some of the stress on the flexible sheet 130, which would otherwise have to bear all of the deformation to accommodate the insertion of the article.

The second example packaging structure 102 is otherwise made by the same method of making a packaging structure as described with respect to the first example packaging structure 2. The second example packaging structure 102 also is used in a similar manner and subject to similar variations in construction and use, as those described with respect to the first example packaging structure 2. This includes providing the at least three methods of removal of an article from the packaging structure upon shipment.

Figure 9:
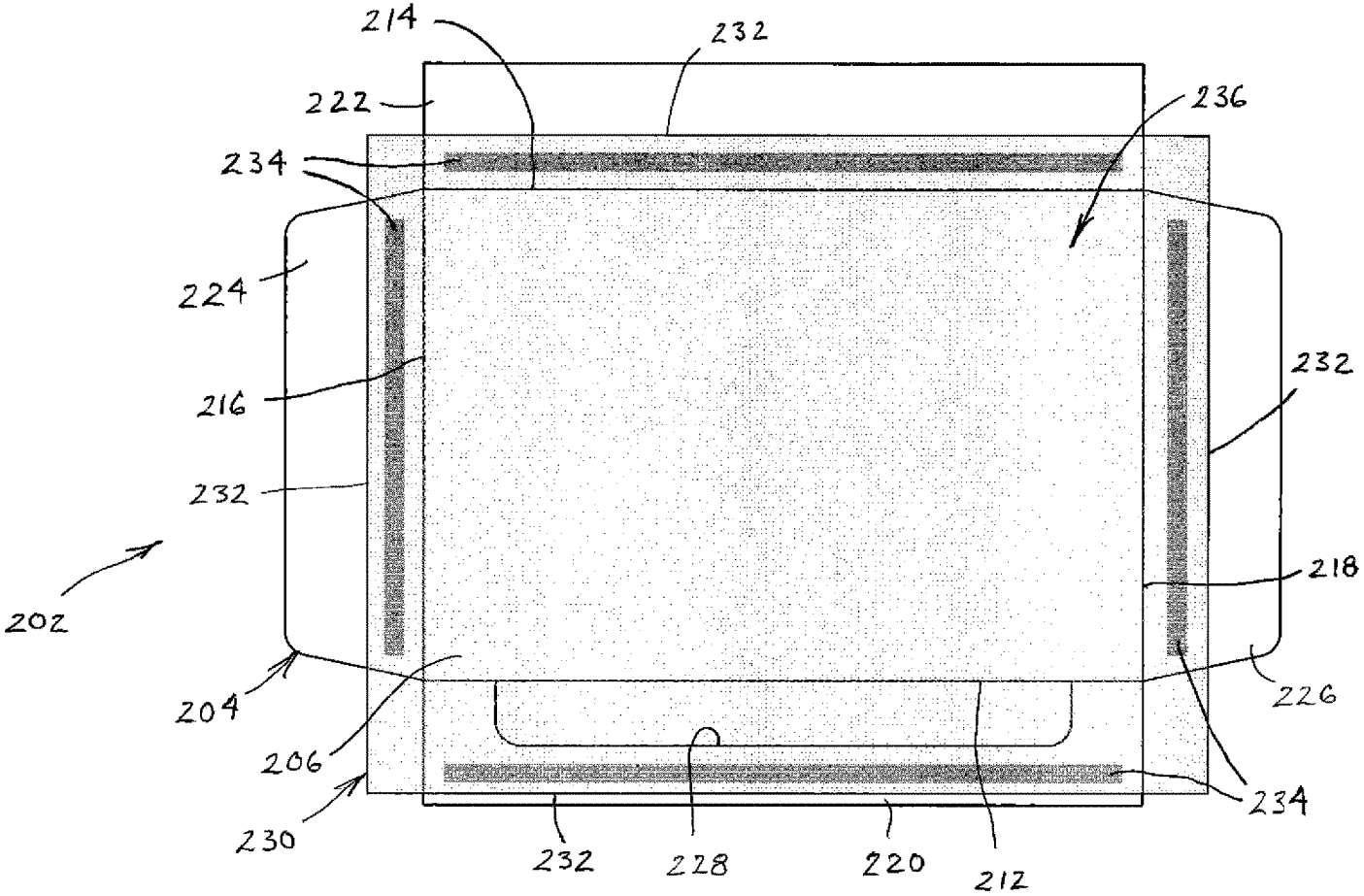
FIG. 9 is a plan view of a third packaging structure adapted for insertion into an outer container and illustrating a support frame shown in a planar orientation and including a platform panel having opposed first and second faces, with at least a first pair of opposed side panels pivotally connected to first opposed sides of the platform panel and at least a second pair of opposed side panels pivotally connected to second opposed sides of the platform panel, and the support frame also having an article-receiving aperture, and a flexible sheet overlies the first face of the platform panel and the article-receiving aperture.

FIG. 9 shows a third example packaging structure 202 that is illustrated as being constructed in a manner somewhat similar to the way the first example packaging structure 2 is constructed. Accordingly, the packaging structure 202 includes a support frame 204 having at least a platform panel 206 having first and second opposed faces 208, 210. The support frame 204 includes at least one article-loading aperture 228. At least a first pair of opposed side panels 220, 222 are pivotally connected to first opposed sides 212, 214 of the platform panel 206, such as along fold lines or other lines of weakness F, which may be formed in a manner as discussed with respect to the above first example. The support frame 204 also may be constructed of various different materials, as discussed above with respect to the first example packaging structure 202.

The third example packaging structure 202 also optionally may include at least a second pair of opposed side panels 224, 226 which are pivotally connected to second opposed sides 216, 218 of the platform panel 206, similarly along fold lines or other lines of weakness. As with the prior example, the support frame 204 has an overall length in a first direction that includes the platform panel 206 and the first pair of opposed side panels 220, 222 when the support frame 204 and the first pair of opposed side panels 220, 222 are disposed in a planar orientation, and an overall length in a second direction that includes the platform panel 206 and the second pair of opposed side panels 224, 226 when the support frame 204 and the second pair of opposed side panels 224, 226 are disposed in a planar orientation.

A flexible sheet 230 is provided, as discussed above with respect to the first example in terms of size and various types of material that may be used. The flexible sheet 230 overlies at least a portion of the first face 208 of the platform panel 206 and extends over and beyond the at least one article-loading aperture 228 in the support frame 204. In this embodiment, the article-loading aperture 228 is a generally elongated rectangular aperture located in side panel 220. One edge of the aperture extends along and is generally coincident with the fold line at the side 212 that occurs between the side panel 220 and the platform panel 206. This positioning of the article-loading aperture 228 may be varied as needed for a particular application.

In this example, the flexible sheet 230 has outer edges 232 and is of a size generally to overlie at least a portion of one of the at least first pair of opposed side panels 220, 222 and is connected thereto with the connection of the flexible sheet 230 to the support frame 204 defining a substantially continuous zone of connection 234 to form an article-receiving area 236 between the flexible sheet 230 and the first face 208 of the platform panel 206, whether the connection is to the first face 208 of the platform panel 206 and/or to the first and/or second opposed side panels 220, 222, 224, 226, and forms an article-receiving area 236 between the flexible sheet 230 and the first face 208 of the platform panel 206.

The article-receiving area 236 is circumscribed by the substantially continuous zone of connection 234, with it being understood that the substantially continuous zone of connection essentially is defined by there not being large enough gaps in the zone of connection to permit insertion of the article A that is intended to be held within the packaging structure 202, so that the article-receiving 236 area is accessible to an article only by loading through the article-loading aperture 228. The flexible sheet 230 overlying the platform panel 206 also is tensioned when the at least one of the at least first pair of opposed side panels 222 is pivoted away from the first face 208 of the platform panel 206. In this example, the flexible sheet 230 has outer edges 232 and is of a size generally to overlie at least a portion of the first face 208 of the platform panel 206, to extend over and beyond the at least one article-loading aperture 228 in the support frame 204, and to overlie at least a portion of one of the at least first pair of opposed side panels 220.

Figure 10:
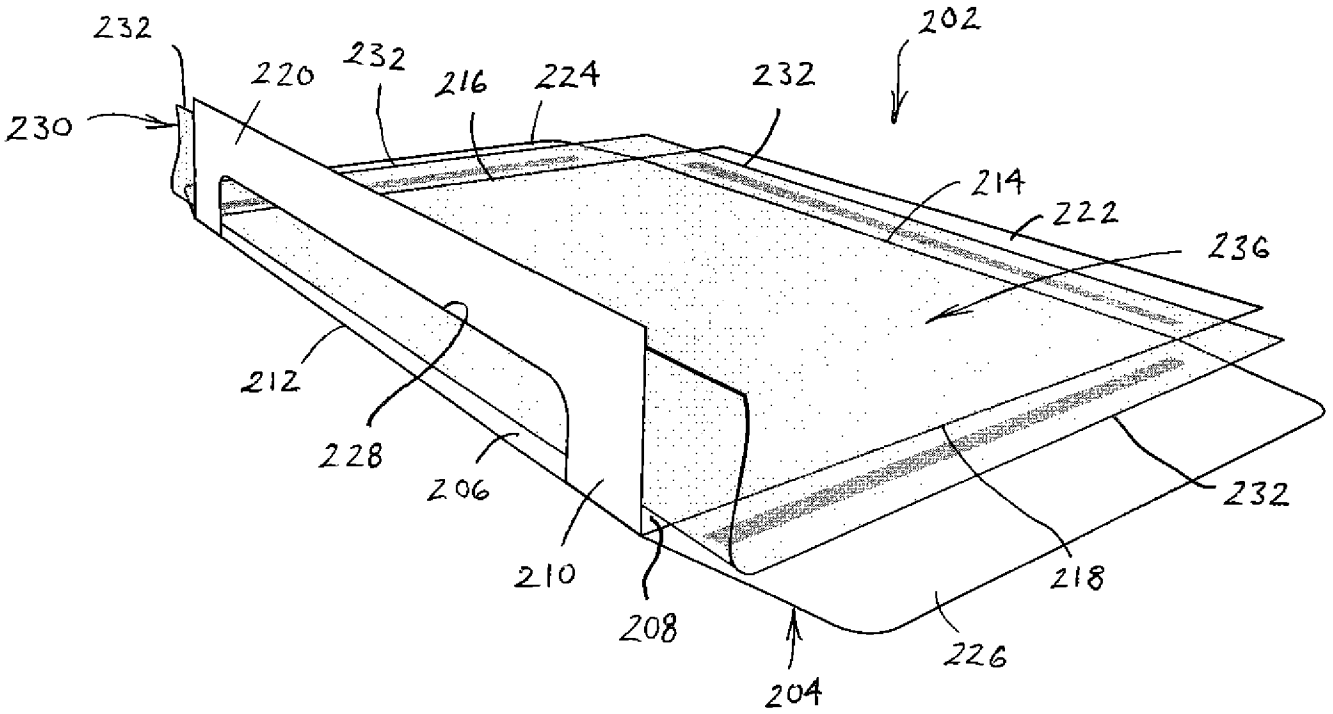
FIG. 10 is a further upper perspective view of the third packaging structure of FIG. 9 shown with the article-loading aperture formed in one of the first opposed side panels that is pivoted to a position perpendicular to the platform panel wherein the article-loading aperture is positioned to permit loading of an article between the flexible sheet and the first face of the platform panel.
Figure 11:
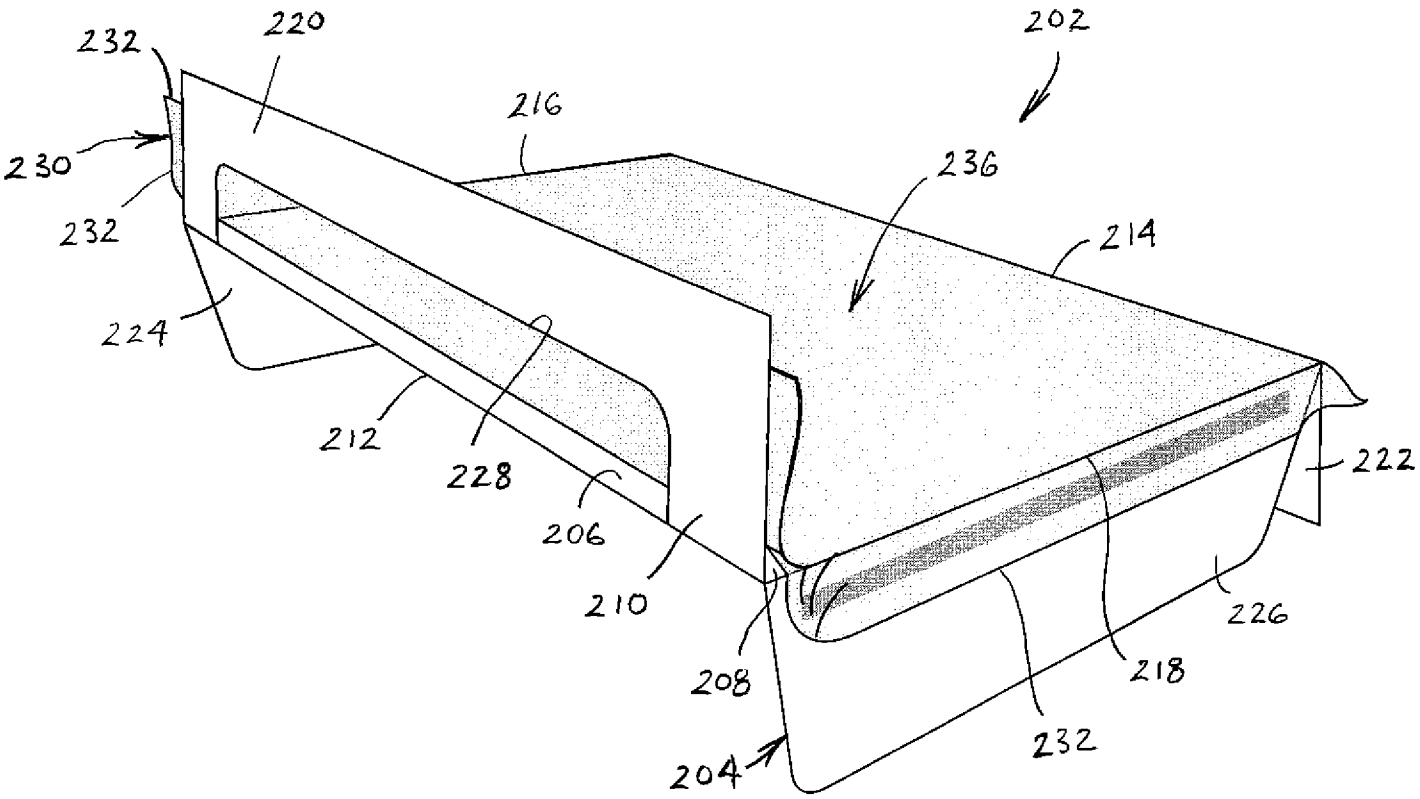
FIG. 11 is an upper perspective view of the packaging structure of FIG. 10 with the other of the first opposed side panels and the pair of second opposed side panels pivoted to a position away from the first face of the platform panel, resulting in tensioning of the flexible sheet.
Figure 12:
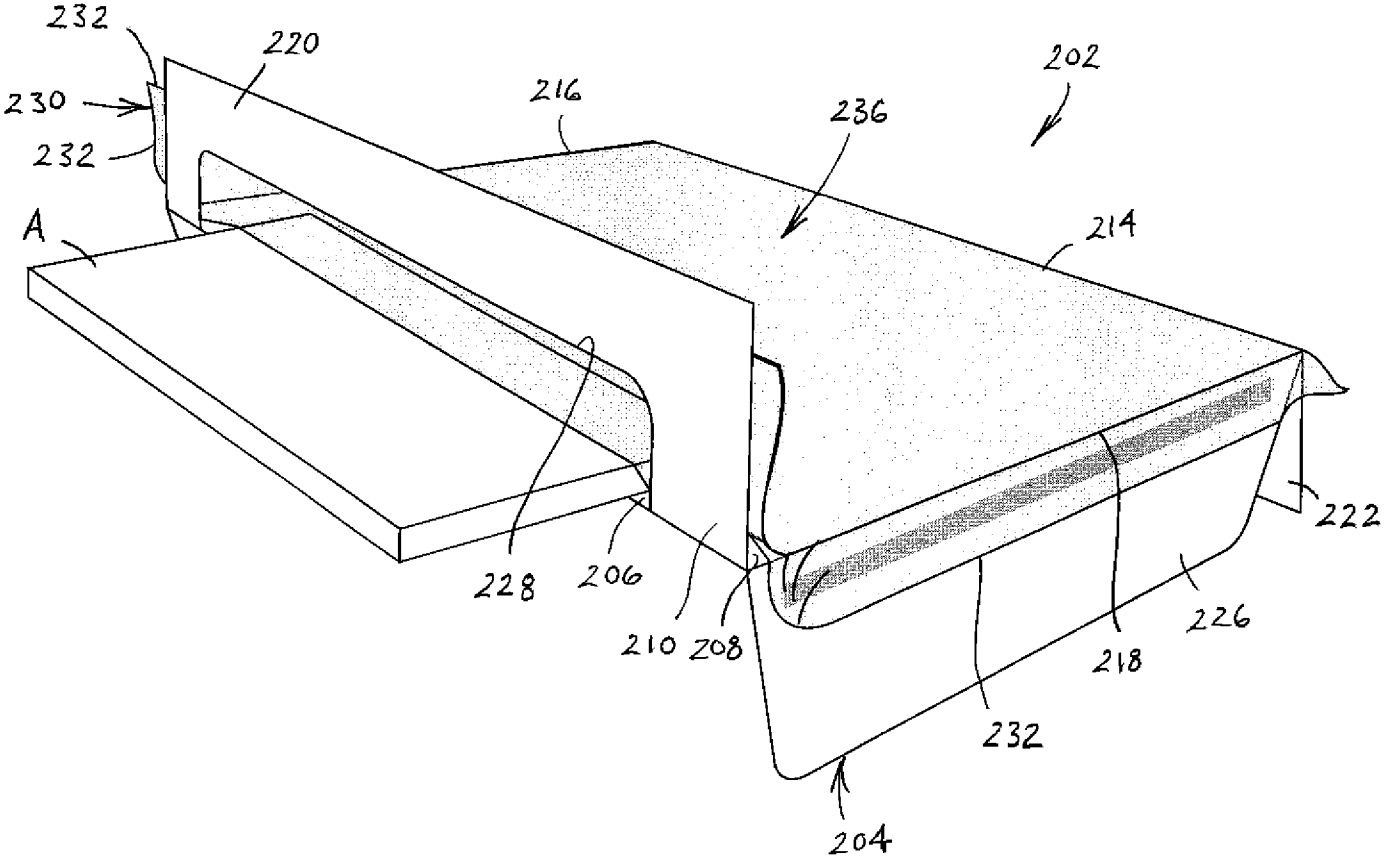
FIG. 12 is an upper perspective view of the packaging structure in the configuration of FIG. 11 and showing an article being inserted through the article-loading aperture to be positioned in an article-receiving area between the flexible sheet and the first face of the platform panel.

In the third example, additional tension is provided by the connection of the flexible sheet 230 to the second pair of opposed side panels 224, 226 and the subsequent pivoting of the second pair of opposed side panels 224, 226 away from the first face 208 of the platform panel 206, as may be seen in FIG. 11. As may be seen in FIGS. 10-12, when an article-receiving aperture is formed in one or more of the side panels of the first and/or second opposed side panels, such as the article-loading aperture 228 in the first opposed side panel 220 of the third example, article loading may be facilitated by pivoting the opposed side panel 220 to a position perpendicular to the platform panel 206. This presents to the user a clearly defined aperture for insertion of an article A between the flexible sheet 230 and the platform panel 206, while holding the flexible sheet 230 partially away from the first face 208 of the platform panel 206 to reduce obstruction by the flexible sheet 230 and provide for easier insertion.

In this example, the article A is depicted generally as a small rectangular block. However, as previously described with respect to the first example, it will be appreciated that the article may be of any shape and size, with appropriate adjustments in the shape and size of packaging structure and the article-loading aperture, the rigidity of the platform panel, the material and tightness of the overlying flexible sheet, and the tension generating configuration relating to the connection of the flexible sheet to one or more pivoting side panels. Accordingly, the article A may be fully inserted through the article-loading aperture 228 and into the article-receiving area 236 between the flexible sheet 230 and the first face 208 of the platform panel 206, as may be seen in FIG. 13.

Figure 13:
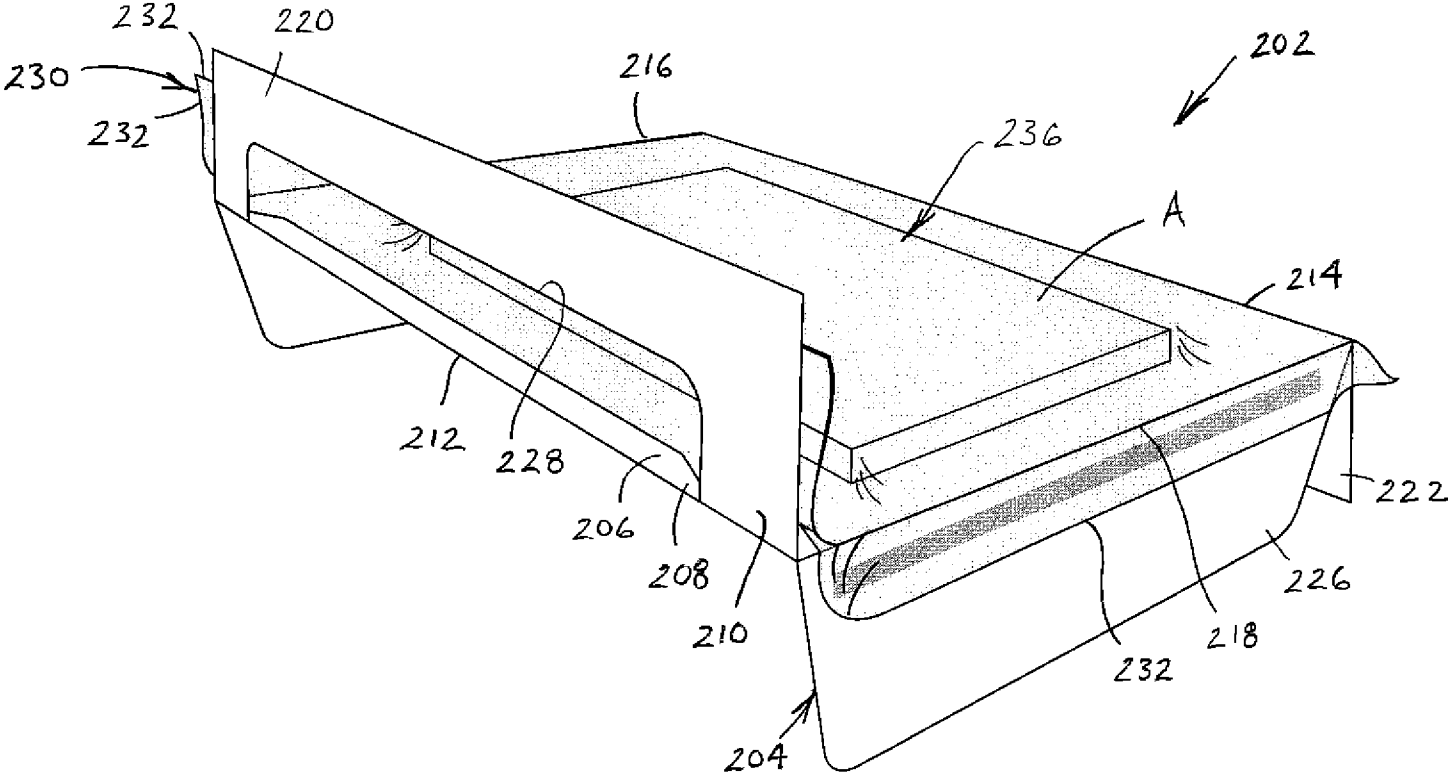
FIG. 13 is an upper perspective view of the packaging structure in the configuration of FIG. 11 having a fully inserted article located in the article-receiving area between the flexible sheet and the first face of the platform panel.

As noted previously, the shape and size of the article A may cause the flexible sheet 230 to stretch to more readily accommodate the thickness and contours of the article A. As shown in FIG. 13, to hold the article A in place against the platform panel 206, the one of the first pair of opposed side panels 222, and the pair of second opposed side panels 224, 226 are pivoted away from the first face 208 and toward the second face 210 of the platform panel 206 along the first opposed sides 212, 214 of the platform panel 206, at fold lines or other lines of weakness. This increases the tension in the flexible sheet 230 that extends beyond the article-loading aperture 228 and is connected to at least the one first opposed side panel 220, and in this example is connected to the first pair of opposed side panels 220, 222. The tension in the flexible sheet 230 will tend to force the article A to press downward against the first face 208 of the platform panel 206, which will help prevent shifting or movement of the article A when placed within an outer container.

Figure 14:
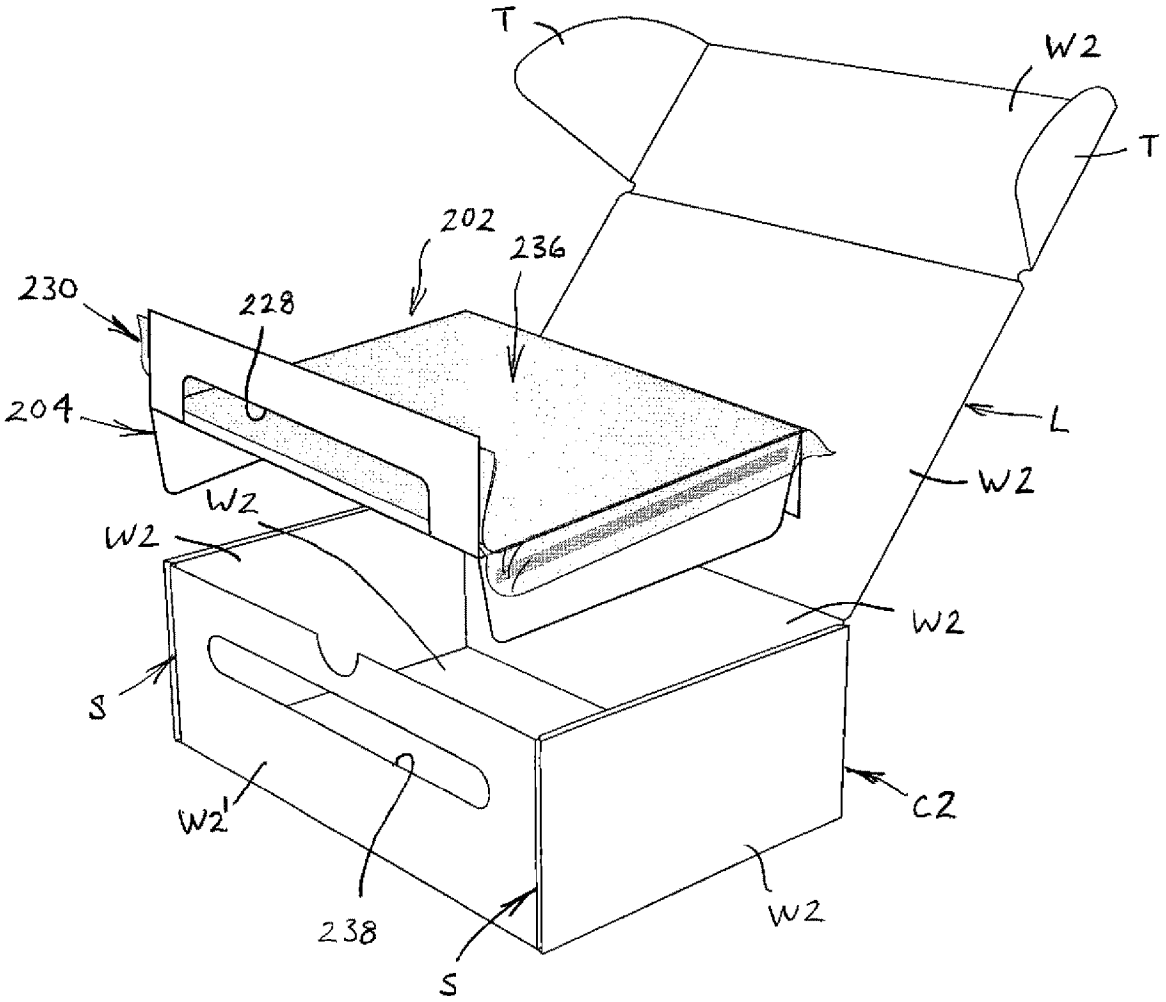
FIG. 14 is an upper perspective view of the packaging structure in the configuration of FIG. 11 as it is being moved into a container having side walls that define a cavity, with one of the side walls having an aperture.
Figure 15:
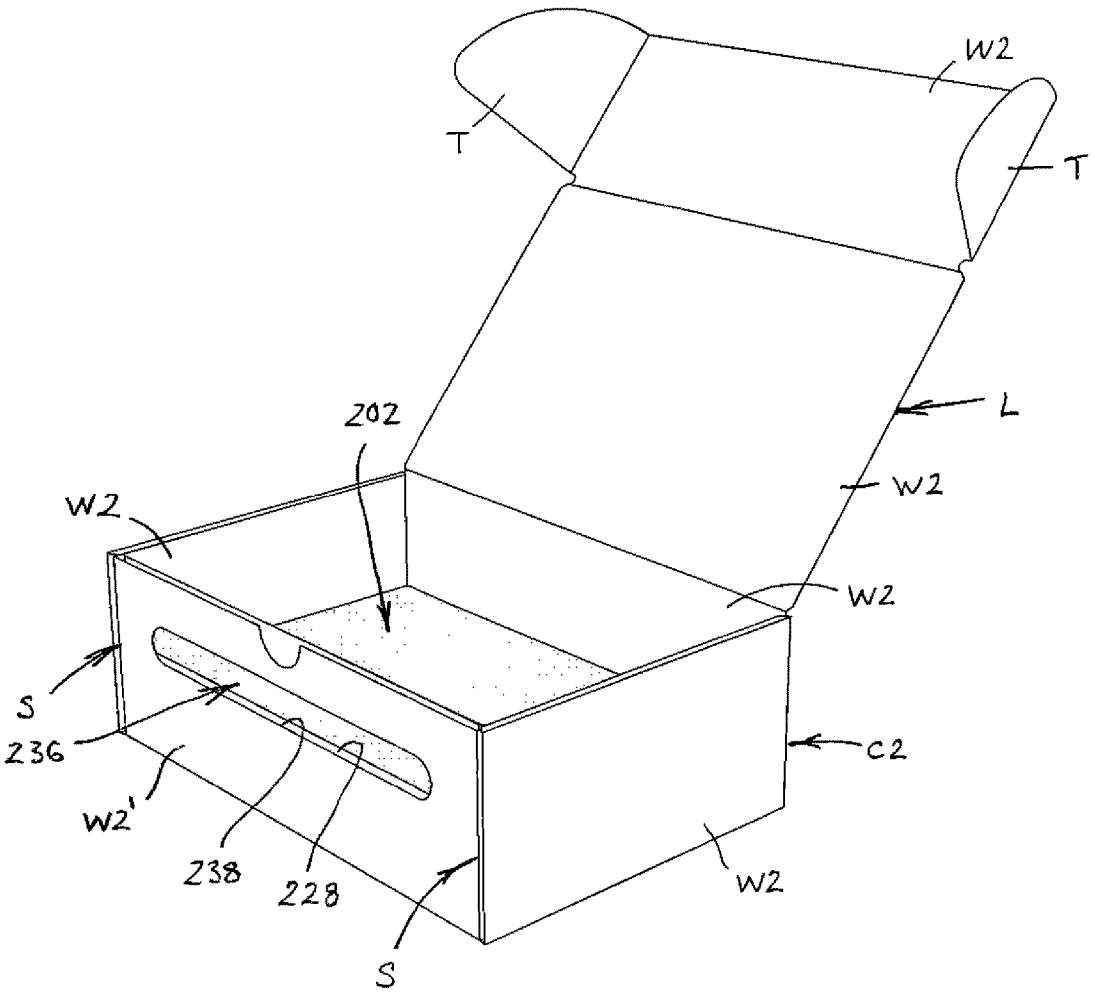
FIG. 15 is an upper perspective view of the packaging structure in the configuration of FIG. 14 fully inserted into the container shown in FIG. 14 and showing the article-loading aperture in the platform panel being aligned with the aperture in the aperture in a side wall of the container.

It will be appreciated that the third example packaging structure 202 may receive an article A, as shown in FIG. 13, and then be placed in a suitably sized container for shipment. However, a more advantageous combination of a container and the example packaging structure 202 is achieved when utilizing a container C2 having an aperture in a side wall that at least roughly corresponds to the article-loading aperture 228 in the packaging structure 202. Thus, as may be seen in FIGS. 14 and 15, the packaging structure 202 may be placed into a container C2, prior to insertion of an article A. The container C2 includes side walls W2, with one of the side walls W2' having an aperture 238 that will be aligned with the aperture 228 in the side panel 220 of the support frame 204 when the packaging structure 202 is fully inserted into the container C2. In this example, the container C2 also includes a lid L that includes first relatively large side wall W2, and a second smaller side wall W2 having retaining tabs T that extend therefrom and that are insertable into slots S that are formed between the side wall W2' and the opposed side walls W2 that are located to the sides of the side wall W2', which are used to retain the lid L in a closed position.

Figure 16:
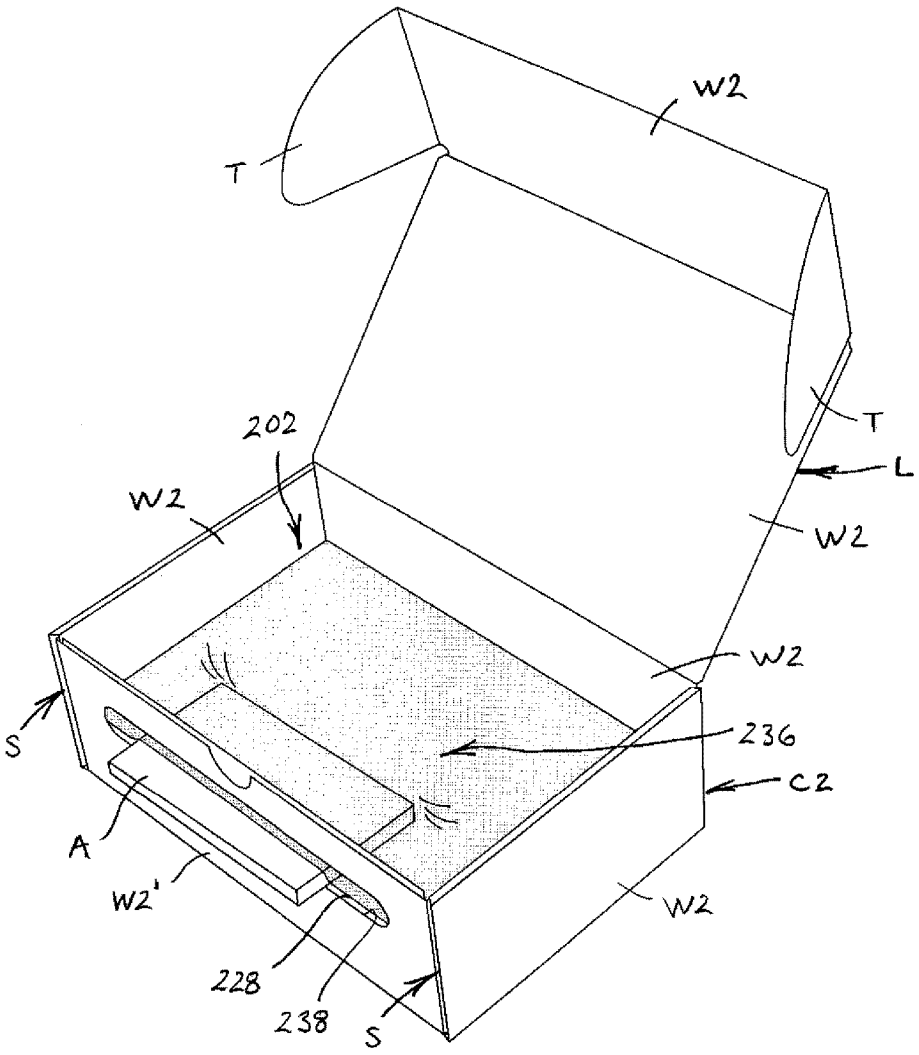
FIG. 16 is an upper perspective view of the packaging structure within the container as shown in FIG. 15 and showing an article being inserted through the aperture in the container side wall and the article-loading aperture to be positioned in an article-receiving area between the flexible sheet and the first face of the platform panel.
Figure 17:
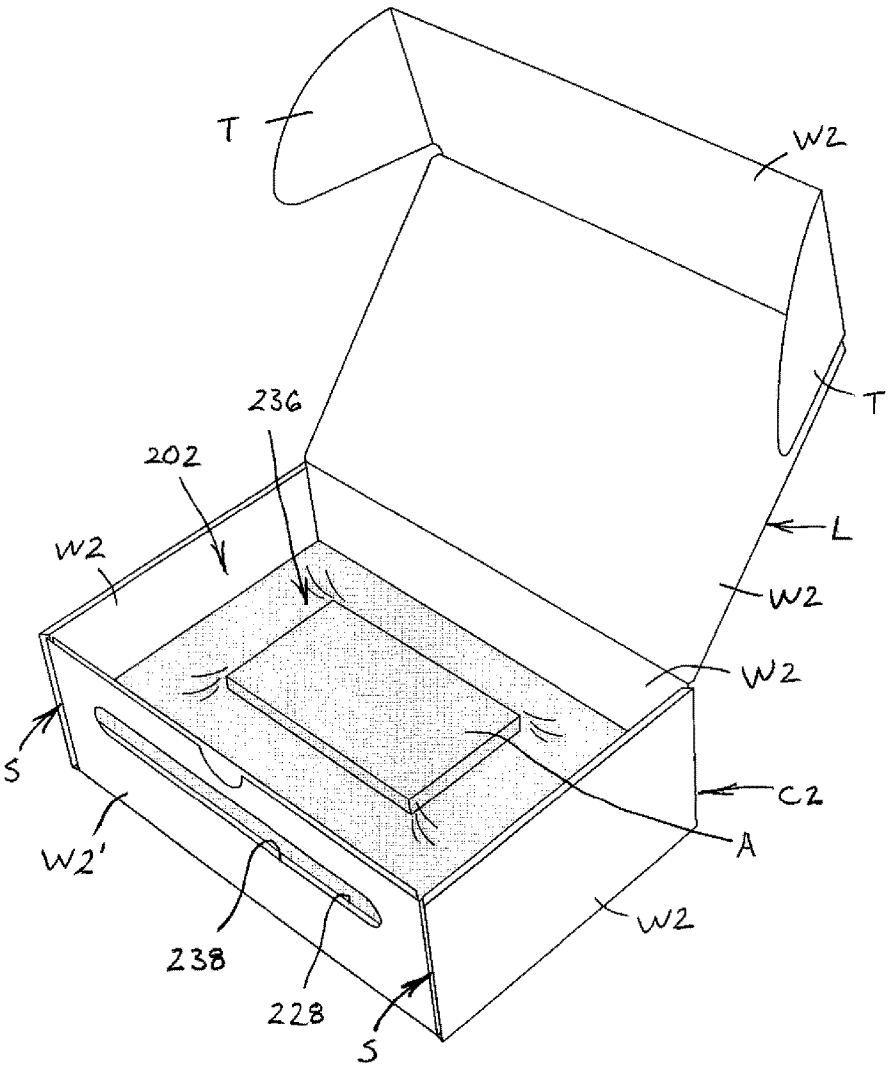
FIG. 17 is an upper perspective view of the packaging structure within the container as shown in FIG. 16 having a fully inserted article located in the article-receiving area between the flexible sheet and the first face of the platform panel.
Figure 18A:
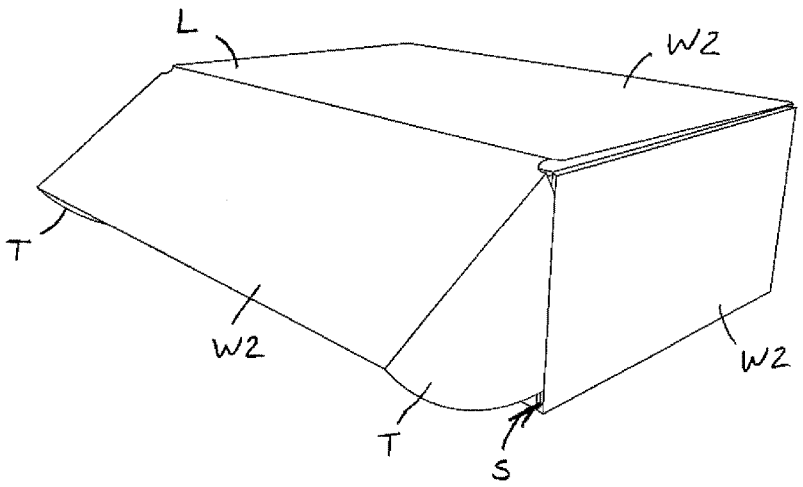
FIGS. 18*a* and 18*b* are upper perspective views of the container shown in FIG. 17 having a lid that forms pivoted side walls being moved to a closed position.
Figure 18B:
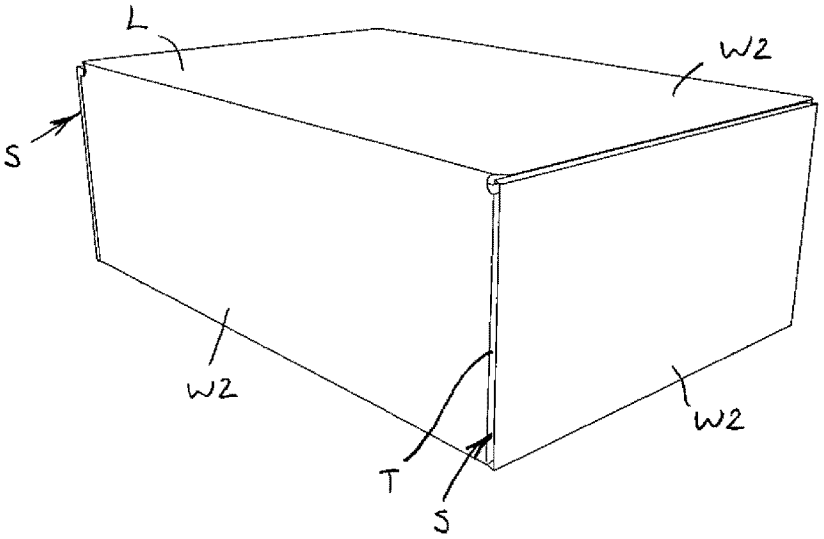

As shown in the successive views of FIGS. 16 and 17, with the packaging structure 202 inserted into the container C2, a user is presented with an assembly that includes a single place to insert an article A. Insertion of article A thus is through the aligned apertures, namely, the aperture 238 in the side wall W2' and the article-loading aperture 228 in the side panel 220 of the support frame 204. Upon full insertion past the side panel 220, as may be seen in FIG. 17, the article A will be located within the article-receiving area 236 between the flexible sheet 230 and the first face 208 of the platform panel 206. As may be seen in FIG. 18*a*, the lid L then may be pivoted toward a closed position, and the leading edge of the retaining tabs T on the furthest most side wall W2 may be inserted into slots S. When the tabs T are fully inserted into the slots S, the furthest most side wall W2 of the lid L lies adjacent the side wall W2' and the container C2 is in a closed position.

A method of making a container C2 and packaging structure 202 that are configured to have an article-loading aperture also is provided. The method includes the steps of providing a support frame 204 having at least a platform panel 206 having first and second opposed faces 208, 210 and at least one article-loading aperture 228 therein, with the support frame 204 having at least a first pair of opposed side panels 220, 222 pivotally connected to first opposed sides 212, 214 of the platform panel 206 and at least a second pair of opposed side panels 224, 226 pivotally connected to second opposed sides 216, 218 of the platform panel 206. The method includes providing at least a portion of the first face 208 of the platform panel 206 and extending over and beyond the at least one article-loading aperture 228 in the support frame 204, and connecting the flexible sheet 230 to the at least one of the first pair of opposed side panels and to the support frame 204 along a substantially continuous zone of connection 234 that forms an article-receiving area 236 between the flexible sheet 230 and the first face 208 of the platform panel 206, which article-receiving area 236 is circumscribed by the substantially continuous zone of connection 234 and is accessible to an article A only through the article-loading aperture 228. The method further includes providing a container C2 having an aperture 238 in a side wall W2', and inserting the packaging structure 202 into the container C2, so as to align the aperture 238 in the side wall W2' with the article-loading aperture 228 in the support frame 204 of the packaging structure 202.

It will be appreciated that the combined container C2 and packaging structure 202 may be used by inserting one or more articles A through the aligned aperture 238 in the side wall W2' and the article-loading aperture 238 in the side panel 220 of the support frame 204, so as to be located between the flexible sheet 230 and the platform panel 206. When an article arrives within a packaging structure 202 of this example, the packaging structure 202 advantageously provides multiple ways in which the article may be removed from the article-receiving area 236, which are similar to those described above with respect to the first example.

Figure 19:
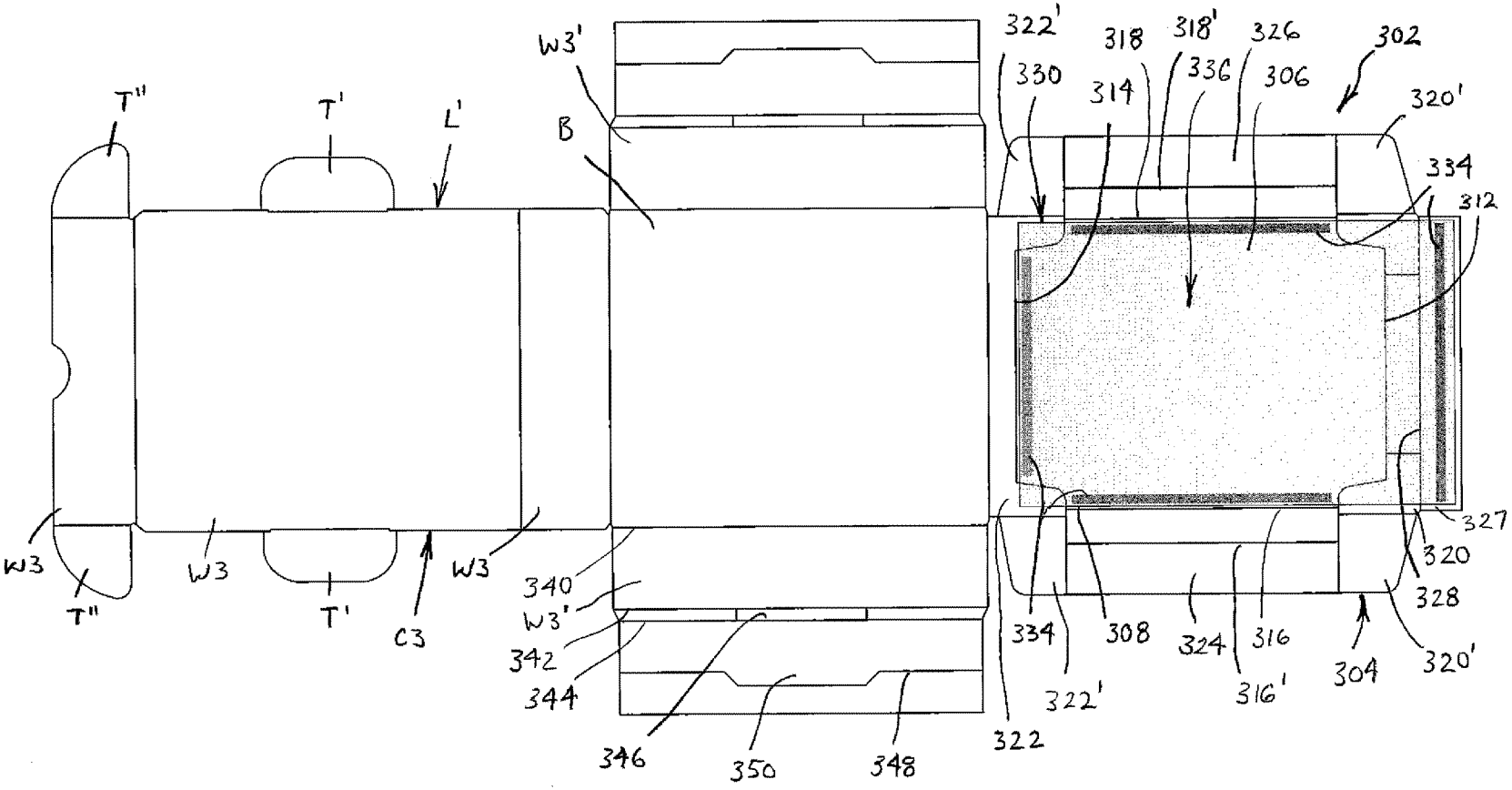
FIG. 19 is a plan view of an example container having a packaging structure with a support frame connected to at least one side wall of the container and illustrating the container and packaging structure with a support frame shown in a planar orientation and having a flexible sheet overlying and connected to the first face of the platform panel with an article-receiving area between the flexible sheet and the first face of the platform panel.
Figure 20:
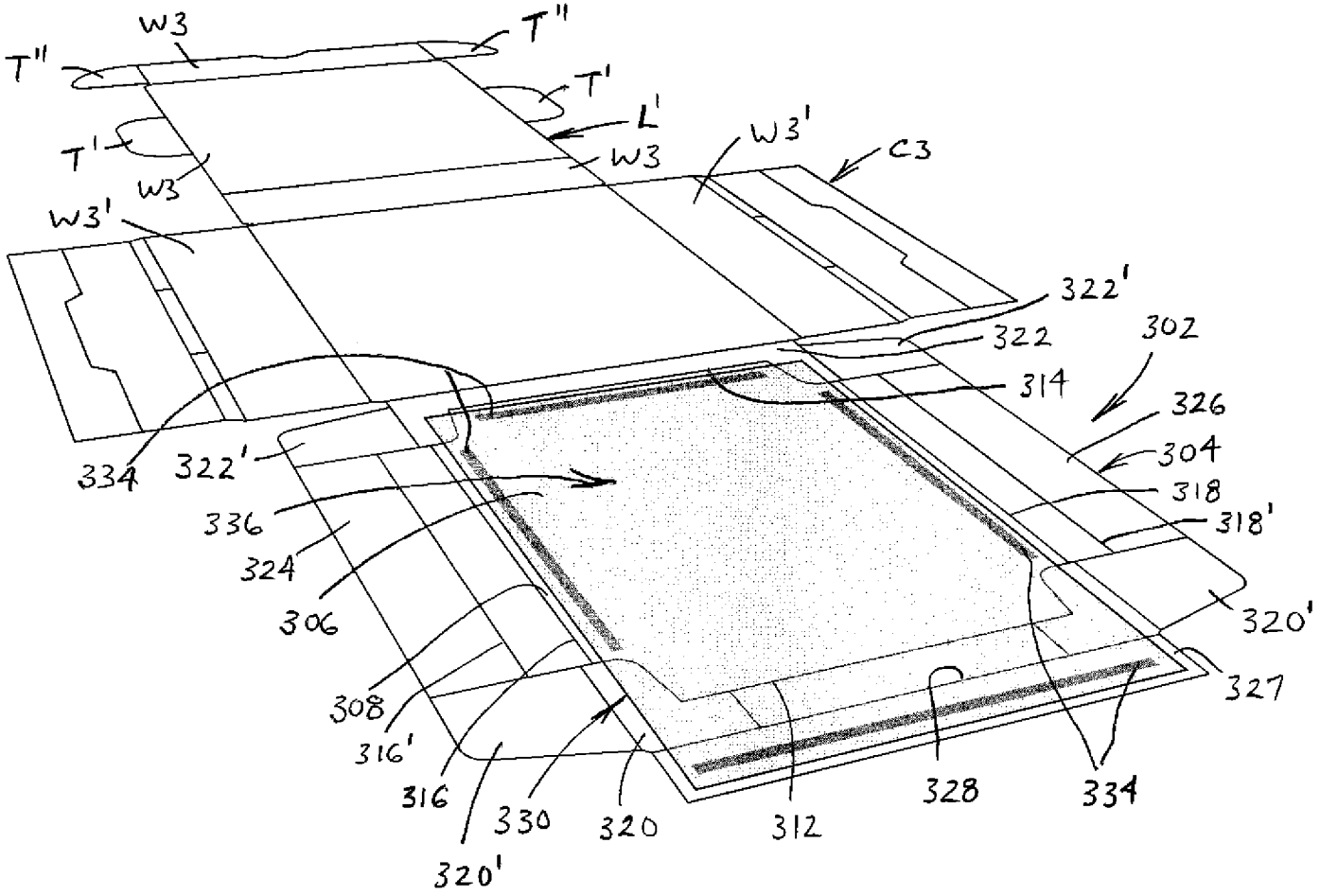
FIG. 20 is an upper perspective view of the example container having a packaging structure with a support frame shown in FIG. 19.

Turning to FIGS. 19-29, a fourth example packaging structure 302 is shown as a portion of an integral packaging structure, such as by being incorporated into or integrally formed with a container C3. Thus, a packaging structure 302 is shown with a support frame 304 connected to at least one side wall W3 of the container C3. FIGS. 19 and 20 show the container and packaging structure combination of the fourth example in a planar orientation. The fourth example packaging structure 302 is illustrated as being constructed in a manner somewhat similar to the way the prior examples were constructed. However, a flexible sheet 330 overlies and is connected to a portion of the first face 308 of the support frame 304, with the flexible sheet specifically overlying at least a portion of a platform panel 306 and a side panel 320 having an article-loading aperture 328 therein.

Accordingly, the packaging structure 302 includes a support frame 304 having at least a platform panel 306 having first and second opposed faces 308, 310. The support frame 304 includes at least one article-loading aperture 328. At least a first pair of opposed side panels 320, 322 are pivotally connected to first opposed sides 312, 314 of the platform panel 306, such as along fold lines or other lines of weakness, which may be formed in a manner as discussed with respect to the above first example. The first pair of opposed side panels 320, 322 of the fourth example also include tabs 320', 322' extending laterally outward therefrom. The support frame 304 also may be constructed of various different materials, as discussed above with respect to the first example packaging structure 302.

The fourth example packaging structure 302 also may include at least a second pair of opposed side panels 324, 326 which are pivotally connected to second opposed sides 316, 318 of the platform panel 306, similarly along fold lines or other lines of weakness, and include secondary fold lines 316', 318' or lines of weakness. As with the prior example, the support frame 304 has an overall length in a first direction that includes the platform panel 306 and the first pair of opposed side panels 320, 322 when the support frame 304 and the first pair of opposed side panels 320, 322 are disposed in a planar orientation, and an overall length in a second direction that includes the platform panel 306 and the second pair of opposed side panels 324, 326 when the support frame 304 and the second pair of opposed side panels 324, 326 are disposed in a planar orientation.

The flexible sheet 330 that is provided may be of similar construction to that discussed above with respect to the first example in terms of size and various types of material that may be used. The flexible sheet 330 overlies at least a portion of the first face 308 of the platform panel 306 and extends over and beyond the at least one article-loading aperture 328 in the support frame 304. In this example, the flexible sheet 330 has outer edges 332 and is of a size generally to overlie at least a portion of one of the at least first pair of opposed side panels 320, 322 that includes the article-receiving aperture 328 and is connected thereto with the connection of the flexible sheet 330 to the support frame 304 defining a substantially continuous zone of connection 334 to form an article-receiving area 336 between the flexible sheet 330 and the first face 308 of the platform panel 306, whether the connection is to the first face 308 of the platform panel 306 and/or to the first and/or second opposed side panels 320, 322, 324, 326, and forms an article-receiving area 336 between the flexible sheet 330 and the first face 308 of the platform panel 306.

The article-receiving area 336 is circumscribed by the substantially continuous zone of connection 334, with it being understood that the substantially continuous zone of connection essentially is defined by there not being large enough gaps in the zone of connection to permit insertion of the article A that is intended to be held within the packaging structure 302, so that the article-receiving area 336 is accessible to an article only by loading through the article-loading aperture 328. In this fourth example, the flexible sheet 330 overlies and is connected to the platform panel 306 along three of the edges 332, while also extending beyond the article-loading aperture 328 and being connected to the first side panel 320. In this example, the flexible sheet 330 is not pre-tensioned.

Figure 21:
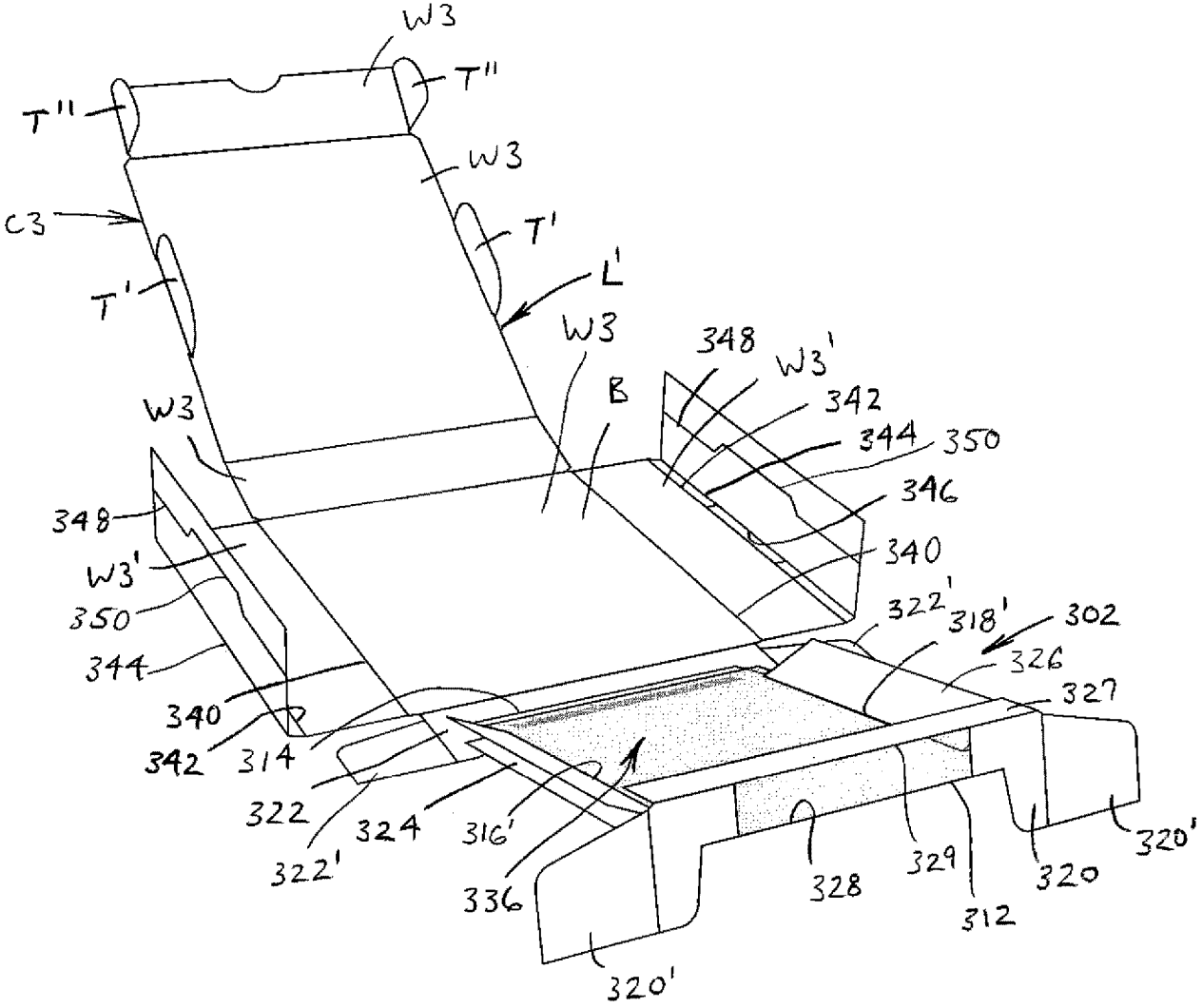
FIG. 21 is an upper perspective view of the example container having a packaging structure with a support frame shown in FIG. 20 having a lid partially pivoted upward with side tabs pivoted upward, portions of container side panels pivoted upward, and a platform panel having opposed first and second faces, with at least one of a first pair of opposed side panels having an article-loading aperture therein and being pivotally connected to a first side of the platform panel and pivoted to a position perpendicular to the platform panel and a second pair of opposed side panels pivoted inward.
Figure 22:
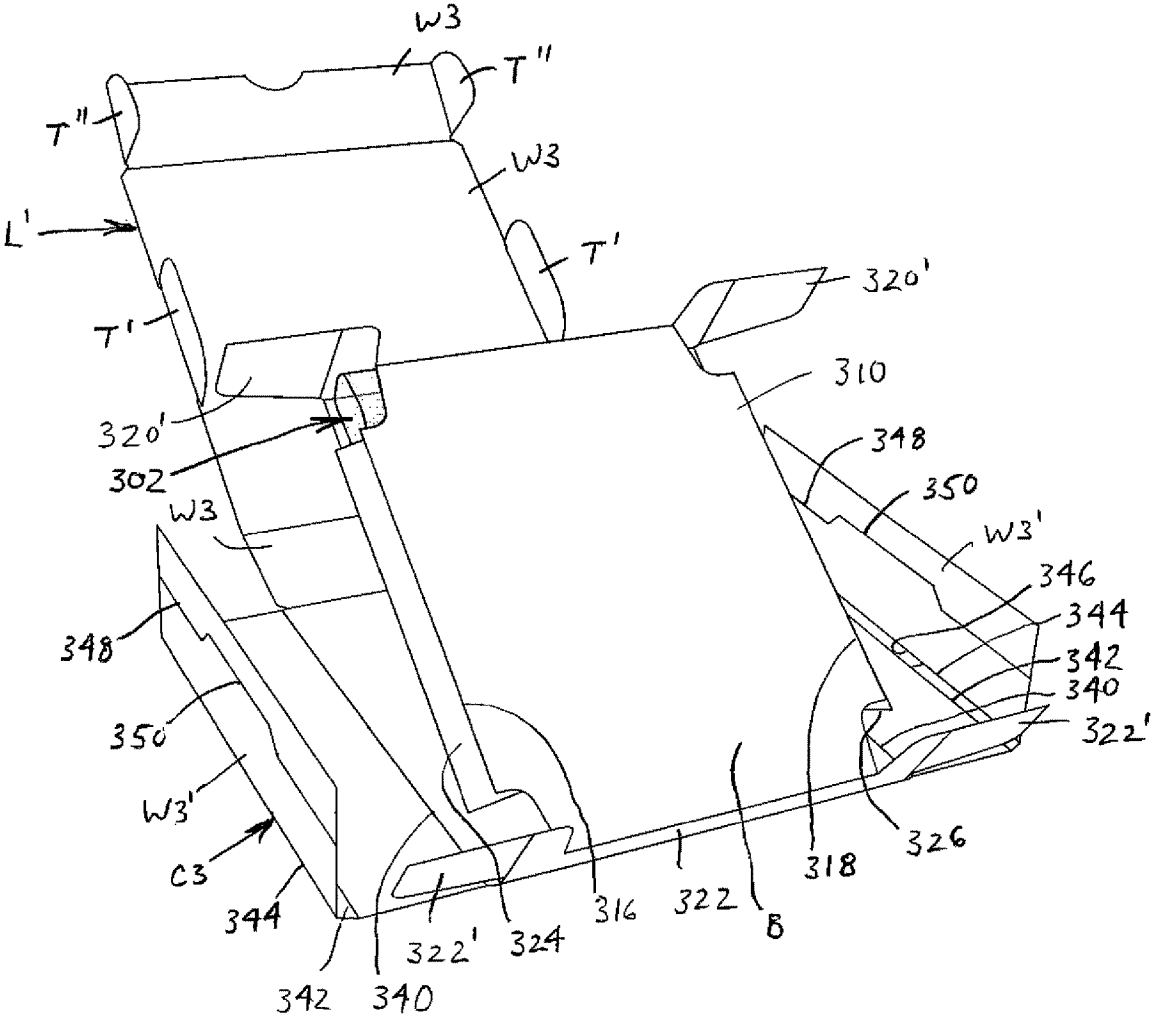
FIG. 22 is an upper perspective view of the example container having a packaging structure with the support frame shown in FIG. 21 in a further pivoted position having the platform panel pivoted toward the container portion with tabs pivoted outward and a second of the first pair of opposed side panels being pivoted toward the first face of the platform panel to a position perpendicular to the platform panel.

In the fourth example, to help keep an inserted article from pulling the flexible sheet 330 away from the first face 308 of the platform panel 306, the second pair of opposed side panels 324, 326 are pivoted inward toward the first face 308 at the sides 316, 318 and then pivoted away from the first face 308 at the secondary fold lines 316', 318', as may be seen in FIG. 21. Thus, the second pair of opposed side panels 324, 326 need not be connected to the flexible sheet 330, but they block the flexible sheet 330 from being pulled away from its points of connection to the platform panel 306.

As may be seen and best understood when comparing FIGS. 21-26, when an article-receiving aperture is formed in a one of the first opposed side panels of the first and/or second opposed side panels, such as the article-loading aperture 328 in the first opposed side panel 320 of the fourth example, article loading may be facilitated by pivoting the support frame 304, such as by pivoting opposed side panel 320 to a position perpendicular to the platform panel 306, pivoting a further portion 327 of the side panel 320 about an edge 329 of the article-loading aperture 328 so as to be parallel to the platform panel 306, and then pivoting the platform panel 306 to a position parallel to the side wall W3 of the container C3 that may be referred to as a base panel B, which has first and second opposed faces. Thus, the support frame 304 is pivoted to a position wherein the first face of the platform panel is in generally face-to-face relation with the first face of the base panel B. The container C3 further includes opposed side walls W3' that include first fold lines 340 at the sides of the base panel B, second and third fold lines 342, 344 that define a narrow region having a slot 346 formed therein, and an outermost non-linear fold line 348 that is cut along the central portion of the fold line 348 to form a locking tab 350.

Figure 23:
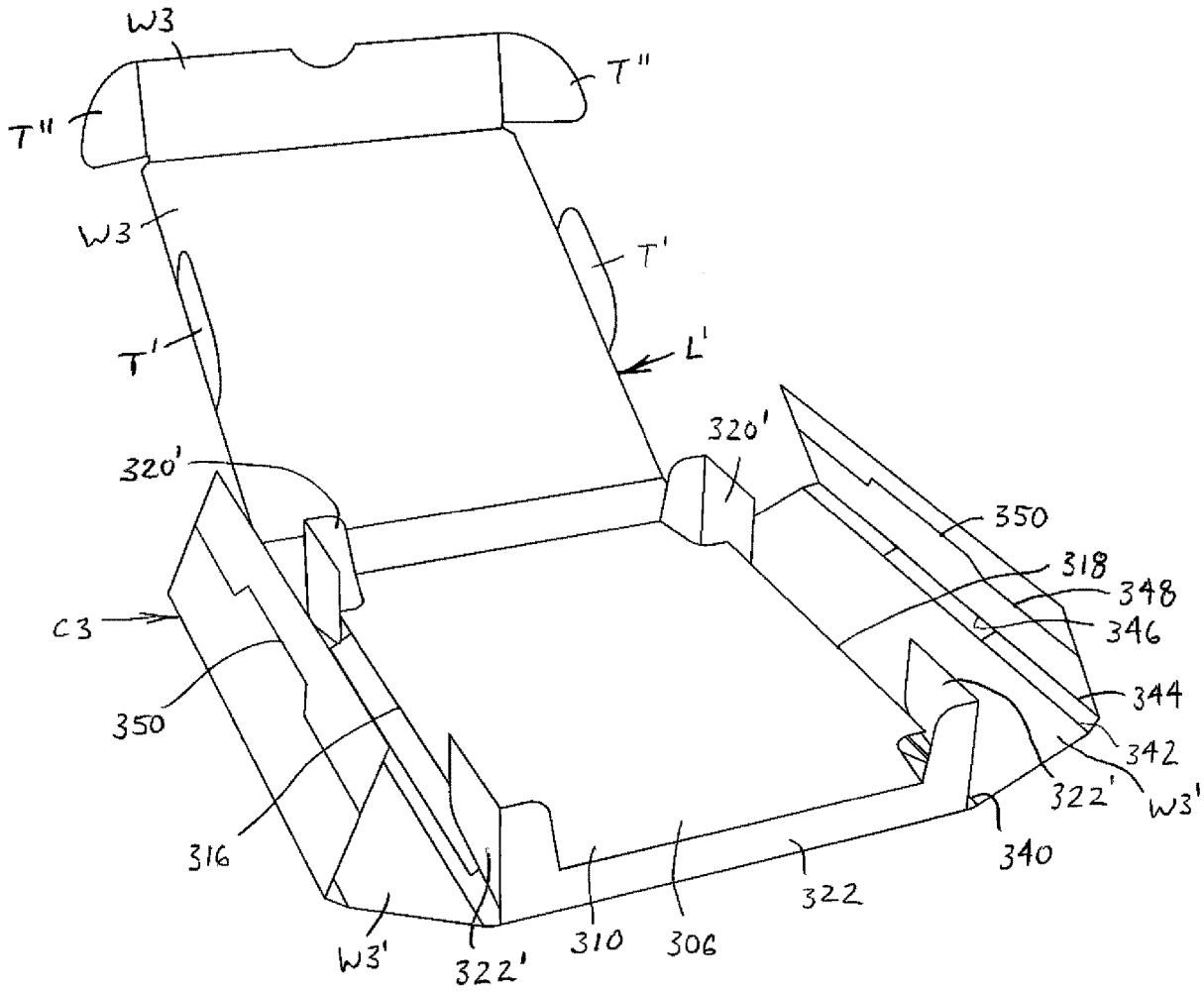
FIG. 23 is an upper perspective view of the example container having a packaging structure with the support frame shown in FIG. 22 in a further pivoted position having the platform panel pivoted to a position parallel to a side wall of the container portion, with the tabs pivoted to corner positions and having portions of the container side panels further pivoted upward toward the second face of the platform panel.
Figure 24:
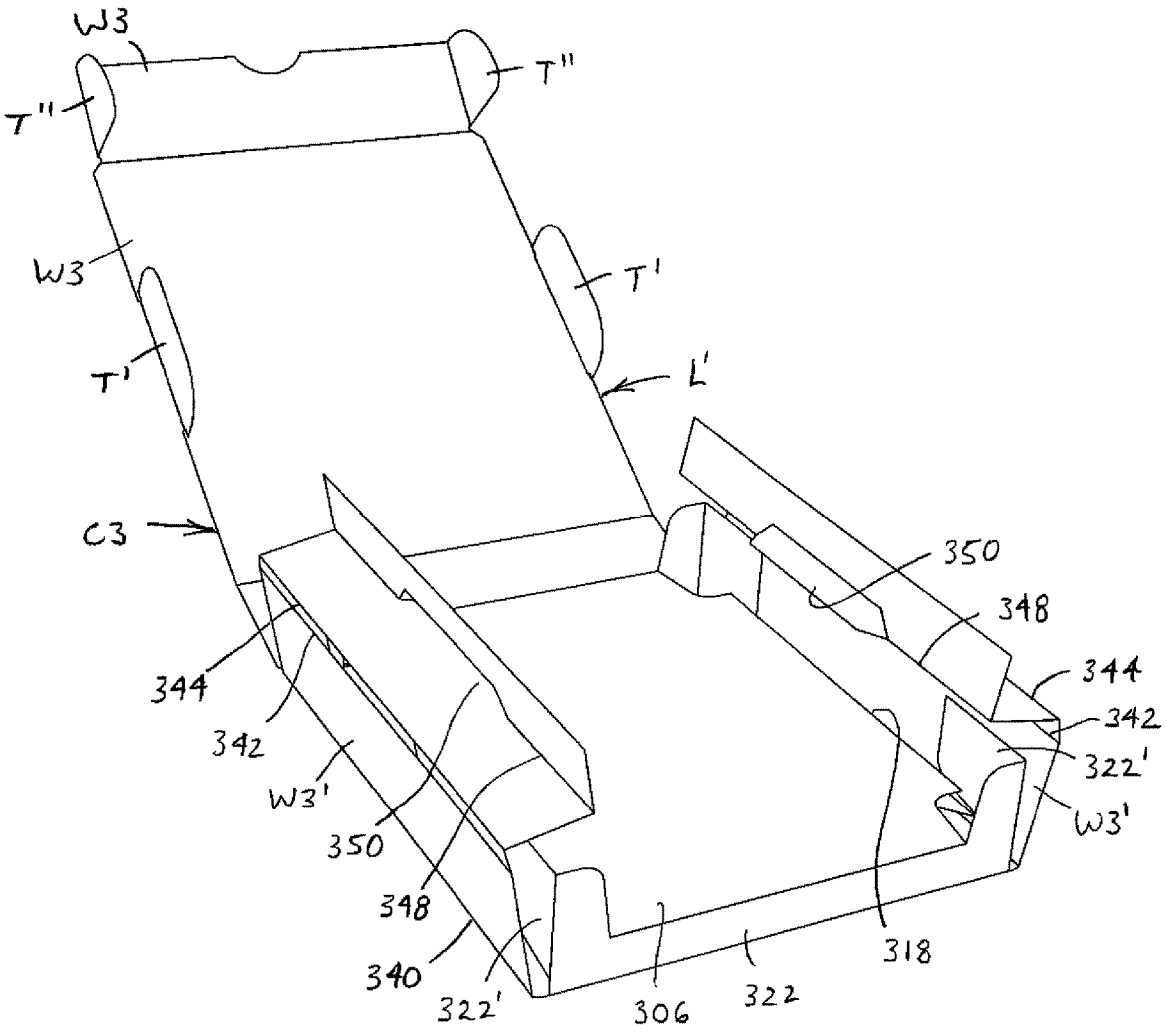
FIG. 24 is an upper perspective view of the example container having a packaging structure with the support frame shown in FIG. 23 in a further pivoted position having portions of the container side panels further pivoted toward the second face of the platform panel and a leading portion pivoted upward to expose locking tabs on the container side panels.
Figure 25:
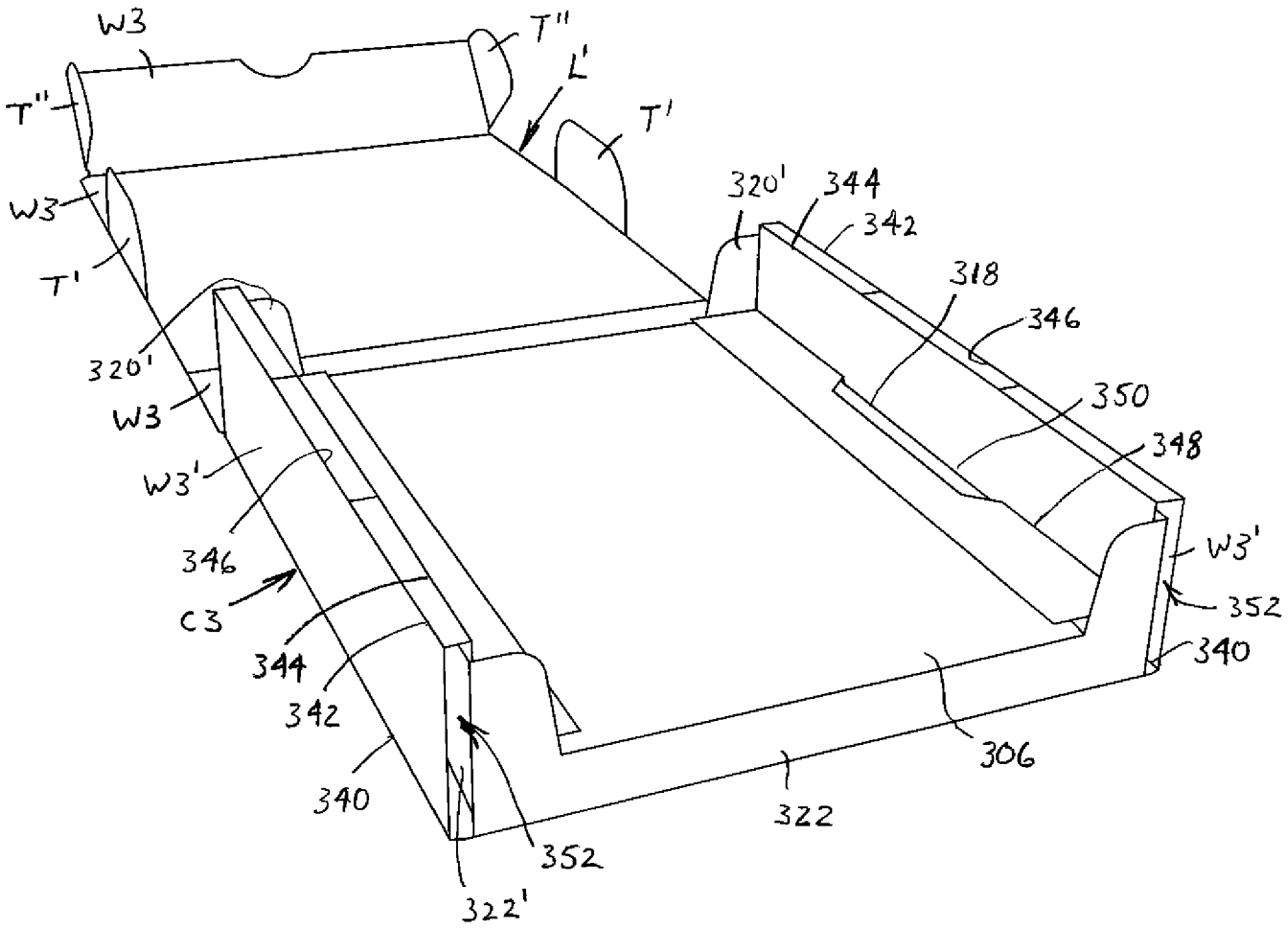
FIG. 25 is an upper perspective view of the example container having a packaging structure with the support frame shown in FIG. 24 in a further pivoted position having portions of the container side panels further pivoted toward the second face of the platform panel and having the locking tabs inserted between sides of the platform panel and side walls of the container.
Figure 26:
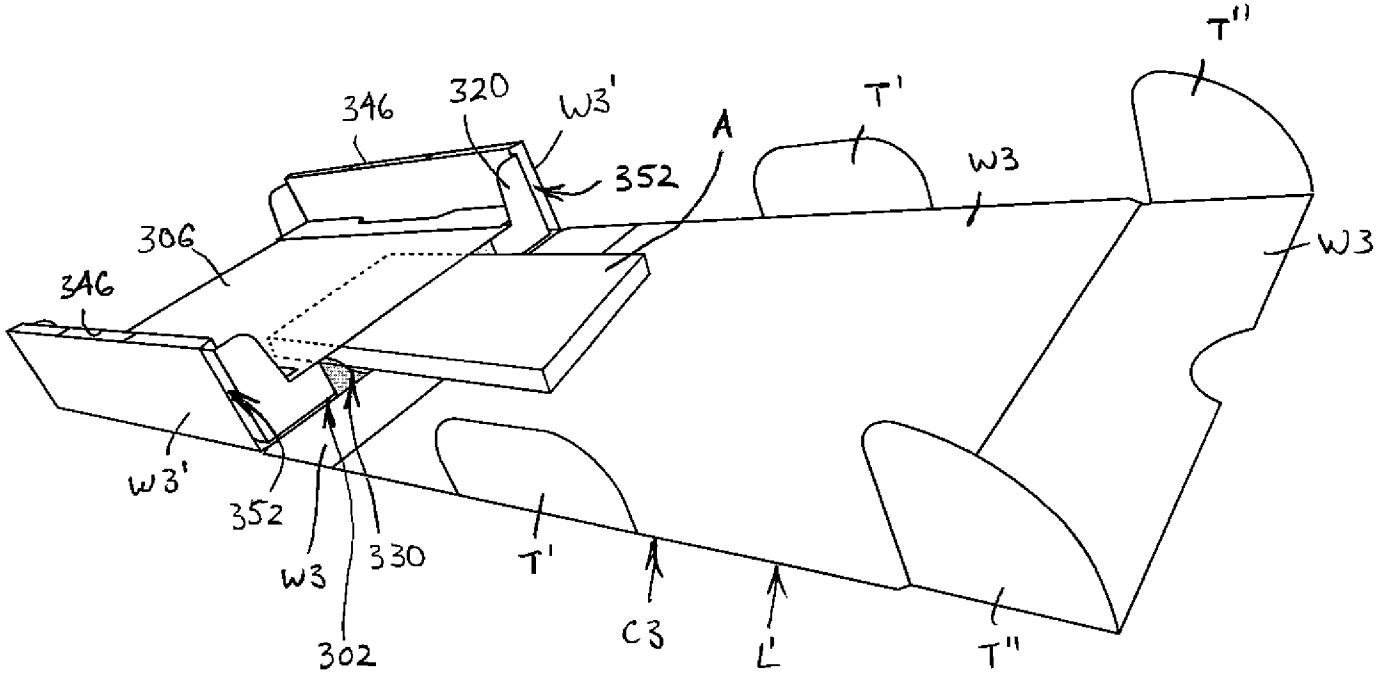
FIG. 26 is an upper perspective view of the example container having a packaging structure with the support frame shown in FIG. 25 rotated to expose the article-loading aperture showing an article being inserted through the article-loading aperture to be positioned in an article-receiving area between the flexible sheet and the first face of the platform panel.
Figure 27:
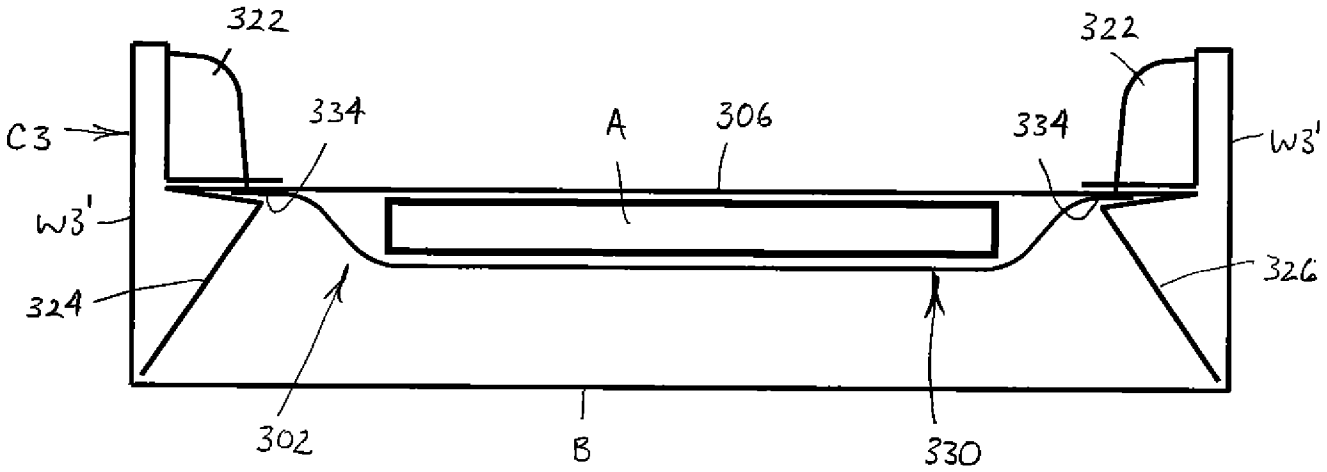
FIG. 27 is a cross-sectional view of the example container having a packaging structure with the support frame shown in FIG. 26 taken through the portion of the article that is partially inserted through the article-loading aperture.
Figure 28:
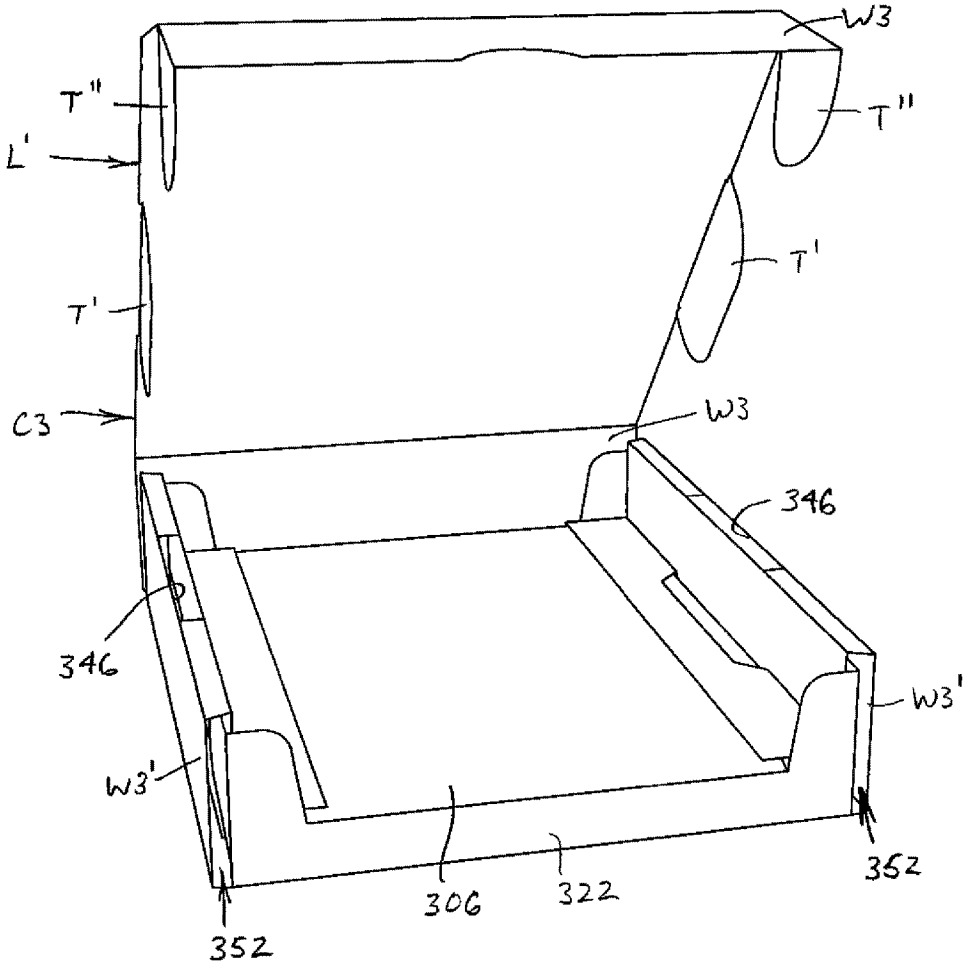
FIG. 28 is an upper perspective view of the example container having a packaging structure with the support frame shown in FIG. 25 and with an article fully inserted into the article-receiving area and the container lid portion being pivoted toward a closed position.

During the succession of views in FIGS. 20-26, it will be appreciated that tabs 320' extending from side panel 320 and the tabs 322' extending from the side panel 322 and are pivoted into a perpendicular position to create corners with the opposed side panels 320, 322, as may be seen in FIG. 23. It also will be appreciated within FIGS. 20-25 that the side walls W3' of the container C3 are pivoted at their successive fold lines 340, 342, 344 toward the base B to form interior walls of the container C3, and then pivoted away from the base panel B at the outermost fold line 348 to allow the locking tabs 350 to be exposed and to be inserted along the sides 316, 318 of the platform panel 306.

Once the aforementioned folds have been completed and the locking tabs 350 are inserted into a locking position, the compartment is formed for receiving an article A. As may be seen in FIG. 26, with the container C3 rotated to expose the side panel 320, the article-loading aperture 328 is presented for a user to simply insert an article A into the combined container C3 and packaging structure 302. It will be appreciated that the platform panel 306 may be positioned so as to leave additional space within the container C3, to accommodate items that may not require the retention provided to the article A. For instance, if shipping a cellular telephone, the telephone may be protected by the retention packaging afforded when the telephone would be inserted through the article-loading aperture 328 and into the article-receiving area 336, while a charger or other less fragile accessories may be contained within the space between the second face 310 of the platform panel 306 and a lid panel L'. The lid panel L' is foldable relative to the base panel B to a pivoted position in which an upper or first face of the lid panel L' is in generally face-to-face relation with the second face of the platform panel 306 in the pivoted condition, thereby positioning the platform panel 306 between the base panel B and lid panel L' and covering the article loading aperture 328 in the support frame. The lid panel L' also includes a first relatively large side wall W3 having retaining tabs T' that extend therefrom and are insertable into slots 346, and a second smaller side wall W3 having retaining tabs T" that extend therefrom and that are insertable into slots 352 that are formed between the side walls W3' and the side panel 320, all of which are used to retain the lid panel L' in a closed position.

Figure 29:
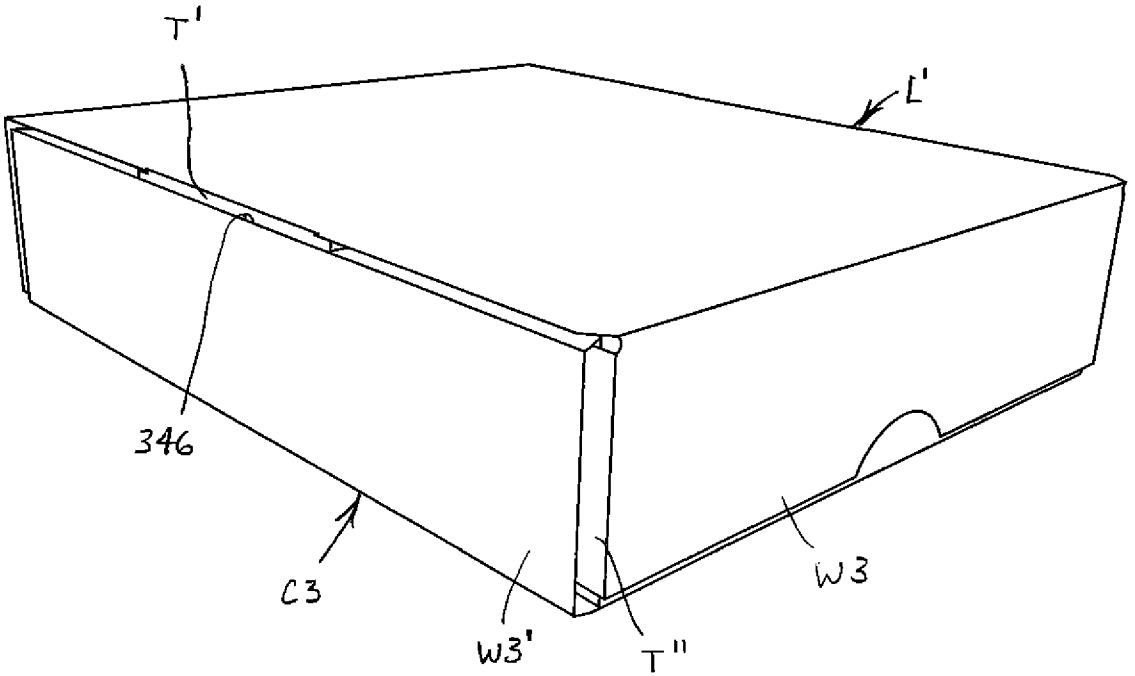
FIG. 29 is an upper perspective view of the example container having a packaging structure with the support frame shown in FIG. 28 with the container lid portion being further pivoted to the closed position.

This is more readily appreciated when viewing FIGS. 29-29. As may be see, after an article A has been inserted through the article-loading aperture 328 and into the article-receiving area 336, the lid panel L' may be pivoted so that a side wall W3 that connects the lid panel L' to the base panel B forms an upright wall of the container C3 and the respective retaining tabs T' may be inserted into the slots 346 along the top of the side walls W3', followed by the retaining tabs T" being inserted into the slots 352 to secure the combined container C3 and packaging structure 302 in a closed position.

Although described in terms of preferred and alternative examples, the present subject matter may be employed in other configurations and with other materials without departing from the principles of the subject matter as described above and as set forth in the following claims.

From the description of the above examples, it will be further understood that this disclosure provides retention packaging that may incorporate many advantages over the prior art. Reduced scrap may be achieved by using simplified shapes for support frames and use of a single flexible sheet and small amounts of glue or fasteners to connect the flexible sheet to the support frame. The connection of the flexible sheet along a first face of the support frame also may permit simplified manufacturing, use of shorter lengths of flexible sheet materials and potentially less flexible sheet material, because the single flexible sheet need not extend beyond the edges of the support frame. Efficient material usage is achieved while providing the desirable condition of having a flexible sheet extending in all directions over the article.

The potential reductions in material usage also may provide cost and weight savings that are important in the initial shipment of packaging structures to a user, as well as in the shipment of packaging structures to a final destination when housing the articles to be shipped. Having a flexible sheet overlie and be connected to one face of a support frame also facilitates easy positioning of the opposed side panels in pivoted positions. The unique structures permit clean and easy assembly and disassembly of the flexible sheets to the support frame, without requiring but optionally permitting the use of mechanical fasteners. This also promotes efficient recycling where the reduction in material usage can be of further benefit, as well.

Thus, the foregoing detailed description and accompanying drawings have been provided by way of explanation and illustration, and are not intended to limit the scope of the appended claims. Many variations in the presently preferred examples illustrated herein will be apparent to one of ordinary skill in the art, and remain within the scope of the appended claims and their equivalents.

The invention claimed is:

1. A packaging structure adapted for insertion into an outer container, comprising:

a support frame having at least a platform panel having first and second opposed faces;

the support frame having at least a first pair of opposed side panels pivotally connected to first opposed sides of the platform panel and at least a second pair of opposed side panels pivotally connected to second opposed sides of the platform panel;

at least one of the side panels of the first pair of opposed side panels having an aperture configured for article loading;

a flexible sheet overlying the first face of the platform panel and extending over and beyond the aperture, the flexible sheet also overlying and being affixed to at least a portion of each of the respective side panels of the first pair of opposed side panels and second pair of opposed side panels so as to define a substantially continuous zone of connection between the flexible sheet and the support frame, and wherein an area that is configured to receive an article is defined between the flexible sheet and the first face of the platform panel, with the area that is configured to receive the article being accessible to the article only through the aperture; and wherein the flexible sheet overlying the platform panel is tensioned when at least one side panel is in a position pivoted away from the first face of the platform panel.

2. The packaging structure of claim 1 wherein the support frame further comprises at least one opening and/or weakened zone.

3. The packaging structure of claim 2 wherein the at least one opening and/or weakened zone is located in the platform panel.

4. The packaging structure of claim 2 wherein the at least one opening and/or weakened zone further comprises at least one slit or aperture that is connected to the article-loading aperture.

5. The packaging structure of claim 1 wherein the aperture is adjacent a pivotal connection of at least one of the first pair of opposed side panels to a respective at least one of the opposed sides of the platform panel.

6. The packaging structure of claim 1 wherein the flexible sheet is comprised of a plastic film material.

7. The packaging structure of claim 1 wherein the flexible sheet is affixed to the support frame by adhesive.

8. The packaging structure of claim 1 wherein at least one of the side panels is pivotable to a position to provide spring suspension of the platform panel.

9. The packaging structure of claim 1 further comprising a container having an aperture in a side wall and wherein the article-loading aperture in the support frame is aligned with the aperture in the side wall of the container.

10. A container having a packaging structure, comprising:

a container having side walls that define a cavity when pivoted to a closed position;

a support frame having at least a platform panel having first and second opposed faces;

the support frame having at least a first pair of opposed side panels pivotally connected to first opposed sides of the platform panel and at least a second pair of opposed side panels pivotally connected to second opposed sides of the platform panel;

at least one of the side panels of the first pair of opposed side panels having an aperture configured for article loading;

a flexible sheet overlying the first face of the platform panel and extending over and beyond the aperture, the flexible sheet also overlying and being affixed to at least a portion of each of the respective side panels of the first pair of opposed side panels and second pair of opposed side panels so as to define a substantially continuous zone of connection between the flexible sheet and the support frame, and wherein an area that is configured to receive an article is defined between the flexible sheet and the first face of the platform panel, with the area that is configured to receive the article being accessible to the article only through the aperture; and wherein the flexible sheet overlying the platform panel is tensioned when at least one side panel is in a position pivoted away from the first face of the platform panel; and wherein the support frame is positioned within the cavity defined by the side walls of the container.

11. The packaging structure of claim 10 further comprising an aperture in at least one of the side walls of the container that is aligned with the article-loading aperture in the support frame when the support frame is positioned within the cavity defined by the side walls of the container.

* * * * *